US011679383B2

(12) United States Patent
Schieffer et al.

(10) Patent No.: US 11,679,383 B2
(45) Date of Patent: Jun. 20, 2023

(54) DYNAMIC BROAD VOLUMETRIC RANGE PIPETTE

(71) Applicant: DeNovix, INC., Wilmington, DE (US)

(72) Inventors: Daniel A. Schieffer, Garnet Valley, PA (US); David L. Ash, Hockessin, DE (US); David B. Ward, Downingtown, PA (US)

(73) Assignee: DeNovix, Inc, Wilmington, DE (US)

( * ) Notice: Subject to any disclaimer, the term of this patent is extended or adjusted under 35 U.S.C. 154(b) by 0 days.

(21) Appl. No.: 17/875,235

(22) Filed: Jul. 27, 2022

(65) Prior Publication Data

US 2022/0362759 A1 Nov. 17, 2022

Related U.S. Application Data

(62) Division of application No. 17/175,287, filed on Feb. 12, 2021.

(Continued)

(51) Int. Cl.
*B01L 3/02* (2006.01)

(52) U.S. Cl.
CPC ..... *B01L 3/0224* (2013.01); *B01L 3/0227* (2013.01); *B01L 3/0237* (2013.01); *B01L 3/0279* (2013.01);

(Continued)

(58) Field of Classification Search
CPC ..... B01L 2200/0605; B01L 2200/143; B01L 2200/146; B01L 2200/147; B01L 2300/02; B01L 2300/023; B01L 3/0237; B01L 2200/14; B01L 3/02; B01L 3/022; B01L 2200/00; B01L 2300/021; B01L 2300/0627; B01L 2300/0636; B01L 2300/0663; B01L 2300/0861; B01L 2300/12;

(Continued)

(56) References Cited

U.S. PATENT DOCUMENTS 5,916,524 A 6/1999 Tisone
6,601,433 B2 8/2003 Kriz et al.

(Continued)

FOREIGN PATENT DOCUMENTS

PL 178640 B1 * 5/2000

OTHER PUBLICATIONS

International Search Report and Written Opinion in international application No. PCT/US2021/017798 dated May 21, 2021.

*Primary Examiner* — Harshad R Patel
*Assistant Examiner* — Truong D Phan
(74) *Attorney, Agent, or Firm* — Potter Anderson & Corroon LLP

(57) ABSTRACT

Multivolume liquid pipettes with nested plunger and vacuum chamber configurations and methods of using such pipettes are disclosed herein. These pipettes typically include a body and a fluid displacement assembly with a small plunger element slideably received within a larger plunger element, each movable within a vacuum chamber for the precise and accurate control of the displacement of fluid, such as air. In turn, this allows for a single device to aspirate and dispense a broad range of liquids in a dynamic, accurate, and precise manner. In addition, the devices disclosed herein may also include a multi-tiered spring-loaded ejection mechanism to allow the user to use and eject pipette tips of different sizes.

14 Claims, 13 Drawing Sheets

Related U.S. Application Data

(60) Provisional application No. 62/976,412, filed on Feb. 14, 2020.

(52) U.S. Cl.
CPC . *B01L 2400/049* (2013.01); *B01L 2400/0478* (2013.01)

(58) Field of Classification Search
CPC ..... B01L 2300/123; B01L 2300/14; B01L 2300/18; B01L 2300/1888; B01L 2400/0478; B01L 3/0231; G01N 35/00871; G01N 35/1009; G01N 35/1016
See application file for complete search history.

(56) References Cited

U.S. PATENT DOCUMENTS 6,715,369 B2 4/2004 Baba et al.
6,931,948 B2 8/2005 Doi et al.
7,105,130 B2 9/2006 Telimaa et al.
7,185,551 B2 3/2007 Schwartz
7,284,454 B2 10/2007 Cote
7,421,913 B2 9/2008 Belgardt et al.
7,434,484 B2 10/2008 Belgardt
7,574,929 B2 8/2009 Telimaa et al.
7,673,531 B2 3/2010 May et al.
7,674,432 B2 3/2010 Wilmer
7,694,592 B2 4/2010 Molitor et al.
7,726,212 B2 6/2010 Magnussen et al.
7,972,575 B2 7/2011 Lind
8,028,592 B2 10/2011 Molitor et al.
8,117,927 B2 2/2012 Millet et al.
8,297,134 B2 10/2012 Wilmer
8,397,593 B2 3/2013 Petrek et al.
8,480,972 B2 7/2013 May et al.
8,631,682 B2 1/2014 Telimaa
8,632,735 B2 1/2014 Kohn et al.
8,656,792 B2 2/2014 Kirste et al.
8,829,473 B1 9/2014 Griswold et al.
9,027,419 B2 5/2015 Wilmer et al.
9,044,749 B2 6/2015 Wilmer
9,084,993 B2 7/2015 Naumann et al.
9,156,031 B2 10/2015 Gruner et al.
9,221,046 B2 12/2015 Petrek et al.
9,358,538 B2 6/2016 Beroz et al.
9,393,561 B2 7/2016 Link
9,440,230 B2 9/2016 Baron
9,566,580 B2 2/2017 Jaaskelainen et al.
9,579,644 B2 2/2017 Belgardt et al.
9,623,406 B2 4/2017 Lind et al.
9,804,064 B2 10/2017 Voyeux et al.
9,931,627 B2 4/2018 Sanchez
9,931,628 B2 4/2018 LaCroix
10,029,250 B2 7/2018 Fetz et al.
2003/0000319 A1* 1/2003 Rainin ..... B01L 3/0217 73/864.14
2005/0220676 A1 10/2005 Tran
2016/0279630 A1* 9/2016 Fracchia ..... B01L 3/0217
2017/0021348 A1 1/2017 Berghall
2017/0028397 A1 2/2017 Dudek
2017/0151556 A1 6/2017 Wilth et al.
2017/0341072 A1 11/2017 Reichmuth et al.
2018/0099270 A1 4/2018 Petrek
2018/0185836 A1 7/2018 Romer et al.
2018/0250667 A1 9/2018 Dudek et al.
2018/0318825 A1 11/2018 Reichmuth et al.
2019/0030525 A1 1/2019 Miettinen et al.
2019/0083969 A1 3/2019 Schiraga et al.
2019/0083970 A1 3/2019 Schiraga et al.
2019/0083971 A1 3/2019 Schiraga et al.
2019/0151839 A1* 5/2019 Dudek ..... B01L 3/0231

* cited by examiner

DYNAMIC BROAD VOLUMETRIC RANGE PIPETTE

CROSS-REFERENCE TO RELATED APPLICATIONS

This application is a divisional of U.S. patent application Ser. No. 17/175,287, filed Feb. 12, 2021, which claims benefit of U.S. Provisional Application No. 62/976,412, filed Feb. 14, 2020, the entire contents of each of which are incorporated by reference herein.

FIELD OF THE INVENTION

The present invention generally relates to pipetting devices capable of dispensing liquids across a broad range of volumes. In particular, described herein is an electronic pipette with a motor-driven piston system that includes a set of nested plunger elements providing separate displacement chambers within a single device.

BACKGROUND OF THE INVENTION

Pipettes and other similar liquid dispensing devices are commonly used in laboratories and in field research for dosage of liquids. Typical pipettes include a piston movable in a cylinder and serving to aspire liquid into and dispense liquid from a disposable tip attached to the dispensing end of the pipette. The liquid volume is usually adjustable. The piston is moved by manual actuation (e.g., force applied to a button) or by means of an electric motor and an associated control system. Electronic pipettes have a control system and associated user interface for setting, e.g., the volume and other necessary pipette functions and for giving commands for performing operations. When the desired function has been selected and the volume and other settings have been entered, depression of an operating switch automatically carries out the actuation of the piston.

Pipettes are commonly used to dispense volumes of liquids that are generally less than about 1 mL and in the range from about 0.5 μl to about 1 mL. However, as will be understood by the skilled artisan, current pipette technology does not allow dispensing liquid volumes across this entire range using a single fluid displacement device—at least not without sacrificing accuracy and precision. Typical wet lab work requiring the dispensing of liquids across this range will require the use of three to four different pipetting devices, each optimized for accurate and precise aspiration/dispensing of a subset of this volumetric range. For instance, a researcher will commonly use a 20 μl pipette for dispensing fluid volumes ranging from about 2 μl to about 20 μl, a 200 μl pipette for dispensing fluid volumes ranging from about 20 μl to about 200 μl, and a 1,000 μl pipette for dispensing fluid volumes ranging from about 100 μl to about 1,000 μl. Having to use multiple devices leads to cluttering of the work area and drives up costs.

There is a need, therefore, for a single pipetting device capable of aspirating and dispensing liquids across a broader range of liquid volumes without sacrificing accuracy and/or precision.

SUMMARY OF THE INVENTION

Described herein is a multi-volume pipetting device capable of aspirating and dispensing liquids across a broad range of volumes with precision and accuracy. In particular, the device disclosed herein preferably employs nested plunger elements that operate within distinct vacuum chambers for the displacement of air, which, in turn, causes the aspiration of an approximately equivalent volume of liquid. The innovative nested plunger design enables the device to dynamically switch from low volumetric range to high volumetric range seamlessly and quickly.

In one aspect, the invention features a pipette that includes a body having an open end to allow a fluid to be introduced into and discharged therefrom and a fluid displacement assembly comprising a first vacuum chamber, a first plunger element, a second vacuum chamber, and a second plunger element. In this aspect, the first vacuum chamber has a first bore with a first fluid inlet. There is a first plunger element that is slideably positionable within the first bore and can be moved between a closed position at the first fluid inlet and an open position. When the first plunger element is in the open position, the first fluid inlet is in fluid communication with the open end. The second vacuum chamber comprises a second bore within the first plunger element and has a second fluid inlet. The second plunger element is slideably positionable within the second bore and can be moved between a closed position at the second fluid inlet and an open position. When the second plunger element is in the open position, the second fluid inlet is in fluid communication with the open end when the second plunger element. The pipette design also features an electronic drive unit for actuating the first plunger element and the second plunger element. The elective drive unit includes a first motor operably connected to the first plunger element and configured to actuate the first plunger element between the closed position and the open position within the first bore; and a second motor operably connected to the second plunger element and configured to actuate the second plunger element between the closed position and the open position within the second bore. The first motor and second motor are controlled with a control system, and the control system is controlled through a user interface for operating the pipette. The second plunger element is in the closed position when the first motor causes the first plunger element to move towards the open position by a distance so as to define a first liquid volume to be aspirated by the pipette device in an amount approximately equivalent to a fluid volume displaced by the movement of the first plunger element. Also, the first plunger element is in the closed position when the second motor causes the second plunger element to move towards the open position by a distance so as to define a second liquid volume to be aspirated by the pipette device in an amount approximately equivalent to a fluid volume displaced by the movement of the second plunger element. Additionally, movement of the first plunger element from the open position to the closed position causes the first liquid volume to be accurately dispensed from the pipette, and movement of the second plunger element from the open position to the closed position causes the second liquid volume to be accurately dispensed from the pipette. In some embodiments, the displaced fluid is air.

Another aspect of the invention features a pipette with a multi-tiered spring-loaded ejector mechanism that includes an ejection assembly disposed on a pipette body, the pipette body having an open end to allow a fluid to be introduced into and discharged therefrom. Further, the ejection assembly comprises an ejector element, an upper ejection portion biased towards an upward position in relation to the open end of the pipette body, a lower ejection portion biased towards an upward position in relation to the open end of the pipette body, a large tip holder portion, and a small tip holder portion, wherein the upper ejection portion is configured to contact the lower ejection portion and move the lower ejection portion to: (i) a first position wherein the upper ejection portion contacts and ejects a tip from the large tip holder portion when a first force is applied to the ejector element; or (ii) a second position wherein the lower ejection portion ejects a tip from the small tip holder portion when a user a second force is applied to the ejector element.

In one embodiment, the large tip holder portion comprises a cross section diameter that is greater than a cross section diameter of the small tip holder portion. In another embodiment, the pipette includes a spring for biasing the upper ejection portion towards the upward position, the lower ejection portion towards the upward position, or both the upper ejection portion and the lower ejection portion towards the upward position. In yet another embodiment, the first force, the second force, or both the first force and the second force is provided manually by an end user.

In another embodiment, the pipette with the multi-tiered spring-loaded ejector mechanism is one in which the fluid displacement assembly includes a first vacuum chamber, a first plunger element, a second vacuum chamber, and a second plunger element. In this aspect, the first vacuum chamber has a first bore with a first fluid inlet. There is a first plunger element that is slideably positionable within the first bore and can be moved between a closed position at the first fluid inlet and an open position. When the first plunger element is in the open position, the first fluid inlet is in fluid communication with the open end. The second vacuum chamber comprises a second bore within the first plunger element and has a second fluid inlet. The second plunger element is slideably positionable within the second bore and can be moved between a closed position at the second fluid inlet and an open position. When the second plunger element is in the open position, the second fluid inlet is in fluid communication with the open end when the second plunger element. The pipette design also features an electronic drive unit for actuating the first plunger element and the second plunger element. The elective drive unit includes a first motor operably connected to the first plunger element and configured to actuate the first plunger element between the closed position and the open position within the first bore; and a second motor operably connected to the second plunger element and configured to actuate the second plunger element between the closed position and the open position within the second bore. The first motor and second motor are controlled with a control system, and the control system is controlled through a user interface for operating the pipette. The second plunger element is in the closed position when the first motor causes the first plunger element to move towards the open position by a distance so as to define a first liquid volume to be aspirated by the pipette device in an amount approximately equivalent to a fluid volume displaced by the movement of the first plunger element. Also, the first plunger element is in the closed position when the second motor causes the second plunger element to move towards the open position by a distance so as to define a second liquid volume to be aspirated by the pipette device in an amount approximately equivalent to a fluid volume displaced by the movement of the second plunger element. Additionally, movement of the first plunger element from the open position to the closed position causes the first liquid volume to be accurately dispensed from the pipette, and movement of the second plunger element from the open position to the closed position causes the second liquid volume to be accurately dispensed from the pipette. In some embodiments, the displaced fluid is air.

In one embodiment, the first liquid volume range comprises an upper limit that is larger than an upper limit of the second liquid volume range, however, in another embodiment, the first liquid volume range and the second liquid volume range overlap one another. In some embodiments, the first liquid volume is in a range from between about 10 μl and about 1,500 μl. In other embodiments, the second liquid volume is in a range from about 0.1 μl to about 200 μl.

In addition, both the first plunger element and the second plunger element are typically cylindrical with the cross-section diameter of the first plunger element being greater than the cross-section diameter of the second plunger element. In yet another, the first plunger element is cylindrical and has a first cross-section diameter (e.g., between about 3 mm to about 20 mm) and the second plunger element is cylindrical and has a second cross-section diameter (e.g., 0.5 mm to about 5 mm), and wherein the first cross-section diameter is greater than the second cross-section diameter. In some embodiments, the ratio of the second cross-section diameter to the first cross-section diameter is about 1:1.1 to about 1:40.

In some embodiments, the first motor is operably connected to the first plunger element by a first piston and the second motor is operably connected to the second plunger element by a second piston.

Other features and advantages of the invention will be apparent by reference to the drawings, detailed description, and examples that follow.

BRIEF DESCRIPTION OF THE DRAWINGS

FIG. 5A depicts the pipetting device with the large plunger element and the small plunger element in the closed positions.

FIG. 5B depicts the pipetting device with the large plunger element moved towards the open position and the end of the small plunger element in contact with the seat in the small vacuum chamber (closed position). In this mode, the pipetting device is configured for aspirating and dispensing liquid by the displacement of air within the large vacuum chamber.

FIG. 5C depicts the pipetting device with the large plunger element and the small plunger element in the closed positions.

FIG. 5D depicts the pipetting device with the small plunger element moved towards the open position and the end of the large plunger element in contact with the seat in the large vacuum chamber (closed position). In this mode, the pipetting device is configured for aspirating and dispensing liquid by the displacement of air within the small vacuum chamber.

FIG. 6A depicts a side view of the embodiment of the pipetting device.

FIG. 6B depicts the inline motor driven piston assembly and fluid displacement system of an embodiment of the pipetting device.

FIG. 6C depicts the small plunger and large plunger assembly of an embodiment of the pipetting device.

FIG. 6D is a bottom view of the large plunger element.

FIG. 6E is a disassembled view of an embodiment of the motor assembly and fluid displacement system of the pipetting device described herein.

FIG. 8A depicts the pipetting device with the large plunger element and the small plunger element in the closed positions.

FIG. 8B depicts the pipetting device with the large plunger element moved towards the open position and the small plunger element in the closed position. In this mode, the pipetting device is configured for aspirating and dispensing liquid by the displacement of air within the large vacuum chamber.

FIG. 8C depicts the pipetting device with the large plunger element and the small plunger element in the closed positions.

FIG. 8D depicts the pipetting device with the small plunger element moved towards the open position and the large plunger element in the closed position. In this mode, the pipetting device is configured for aspirating and dispensing liquid by the displacement of air within the small vacuum chamber.

DETAILED DESCRIPTION OF THE INVENTION

Figure 1A:
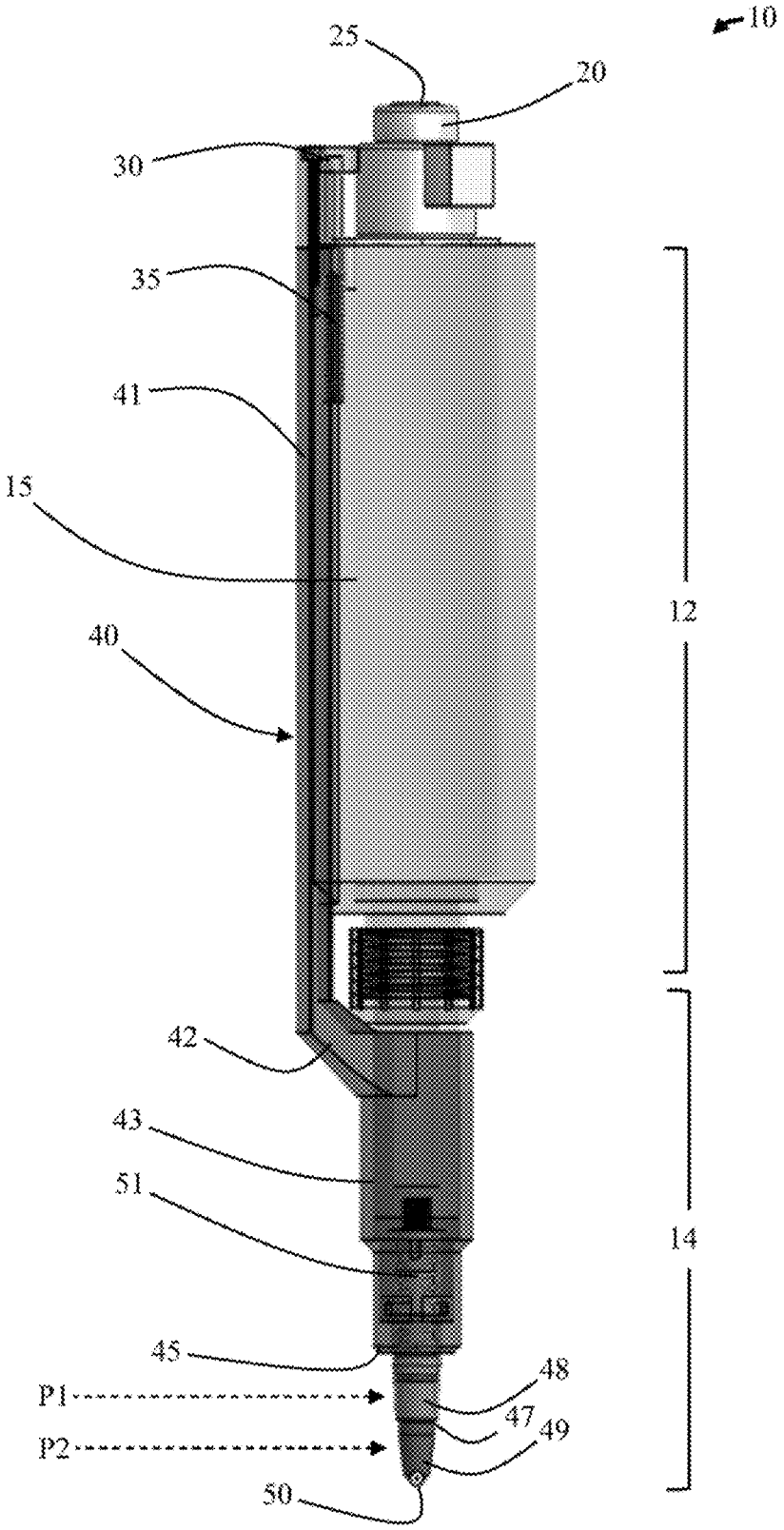
FIG. 1A depicts a side view of an embodiment of the pipetting device described herein.

The pipetting device described herein enables the transfer of a large range of liquid volumes through an innovative dispenser design that comprises two or more motor-driven plunger elements that work in combination to provide multiple volumetric air displacement chambers (i.e., vacuum chambers). In particular, each vacuum chamber may be optimized for precise displacement of fluid, such as air, across a different volumetric range. As the vacuum is created within the chamber, it causes the fluid (e.g., air) to enter into the chamber which, in turn, causes the pipette to aspirate an approximately equivalent volume of liquid. Moreover, it is preferred that each plunger element be driven by a separate motor to allow for rapid and dynamic switching from one vacuum chamber to the next in order to seamlessly enable the user to pipette liquids across a broad range of volumes. In this manner, the pipetting device is capable of aspirating and dispensing liquid across a wider range of volumes as compared to devices currently available. The multiple plunger elements are contained within a device housing such that the physical movement of the plungers within the housing creates the vacuum. In preferred embodiments, the plungers are at least partially contained within a bore or hollow space within a housing or casing in the dispenser section of the device. As the plunger elements move within the hollow space or bore of the vacuum chambers, fluid (e.g., air) is either pulled into the chamber or expelled from the chamber thereby causing a corresponding volume of liquid to be aspirated or dispensed, respectively, from a pipetting tip. The plungers may be made of rigid material, such as plastic or metal. In addition, it is preferable that the plungers be cylindrical in shape although other shapes are possible. As will be explained below, in a preferred embodiment, at least two plunger elements are suitable for use in the invention where the plunger elements are cylindrical and positioned such that they are in a nested configuration.

Unless defined otherwise, all technical and scientific terms used herein have the same meaning as those commonly understood by one of ordinary skill in the art to which this invention belongs. Standard techniques are used unless otherwise specified. Although methods and materials similar or equivalent to those described herein can be used in the practice or testing of the present disclosure, suitable methods and materials are described below. The materials, methods and examples are illustrative only, and are not intended to be limiting. All publications, patents and other documents mentioned herein are incorporated by reference in their entirety.

As used herein, the singular forms "a," "an," and "the" include the plural referents unless the context clearly indicates otherwise.

The term "about" refers to the variation in the numerical value of a measurement, e.g., diameter, area, length, volume, etc., due to typical error rates of the device used to obtain that measure. In one embodiment, the term "about" means within 5% of the reported numerical value.

The term "approximately equivalent" is used herein to refer to the volume of fluid displaced by the device as compared to the volume of liquid aspirated by the device and means that the volume of fluid (e.g., air) displaced by movement of the plunger element within the vacuum chamber is not exactly equal to the volume of liquid aspirated into the tip attached to the end of the device due to the difference between the density of the fluid and the density of the liquid. The device design is calibrated taking into account this factor and is well within the purview of the skilled artisan.

The terms "interference fit" or "friction fit" are used interchangeably herein and refer to a fastening between two parts that is achieved by friction after the parts are pushed together.

The designations "up" and "down," "upward" and "downward," and "horizontal" and "vertical" as used herein refer to an orientation of the pipette device in which the pipette housing is oriented with the actuating member or push-bottom at the top and the dispensing end at the bottom (see, e.g., FIG. 1A). In this orientation, a pipette tip fastened or attached onto the dispensing end of the dispenser housing can be directed towards a vessel situated thereunder, in order to aspirate or deliver a liquid.

Shown in FIGS. 1A-4 are diagrams of an embodiment of a pipetting device of the instant invention. The pipetting device 10 generally has an elongated or rod-like shape with a top drive section 12 that contains the drive unit and all of the associated components encased in a pipette housing 15. The pipetting device 10 also generally includes a bottom fluid displacement and dispensing section 14, which includes a dispenser housing 52 containing at least a portion of the plunger elements 60, 70. An actuating element 20 in the form of a cylindrical push-button projects upwardly from the pipetting housing 15 of the drive section 12. The actuating element 20 is axially moveable within the pipette housing 15 and is used by the user to cause the pipetting device to aspirate or dispense fluid.

The bottom, or dispensing end, of the pipetting device described herein will include at least one holder or seat element for which to fasten a pipette tip for aspirating liquid. It is preferred that the housing or casing at the dispensing end includes two or more seats or holder portions, where one portion of the dispensing housing is configured for attaching a pipette tip of a certain volume, and the other portion of the dispensing housing is configured for attaching a pipette tip of another, different volume. For instance, a typical dispensing housing may include a holder portion for a pipette tip capable of aspirating liquid in a volume ranging from about 10 μl to about 1,500 μl; preferably, the pipette tip will be capable of aspirating liquid in a volume ranging from about 50 μl to about 1,000 μl. In this embodiment, the dispenser housing will include a second holder portion for a pipette tip capable of aspirating liquid in a volume ranging from about 0.50 μl to about 200 μl. As such, the shape/design of the dispensing section should be suitable for accommodating different sized pipette points/tips.

Figure 2:
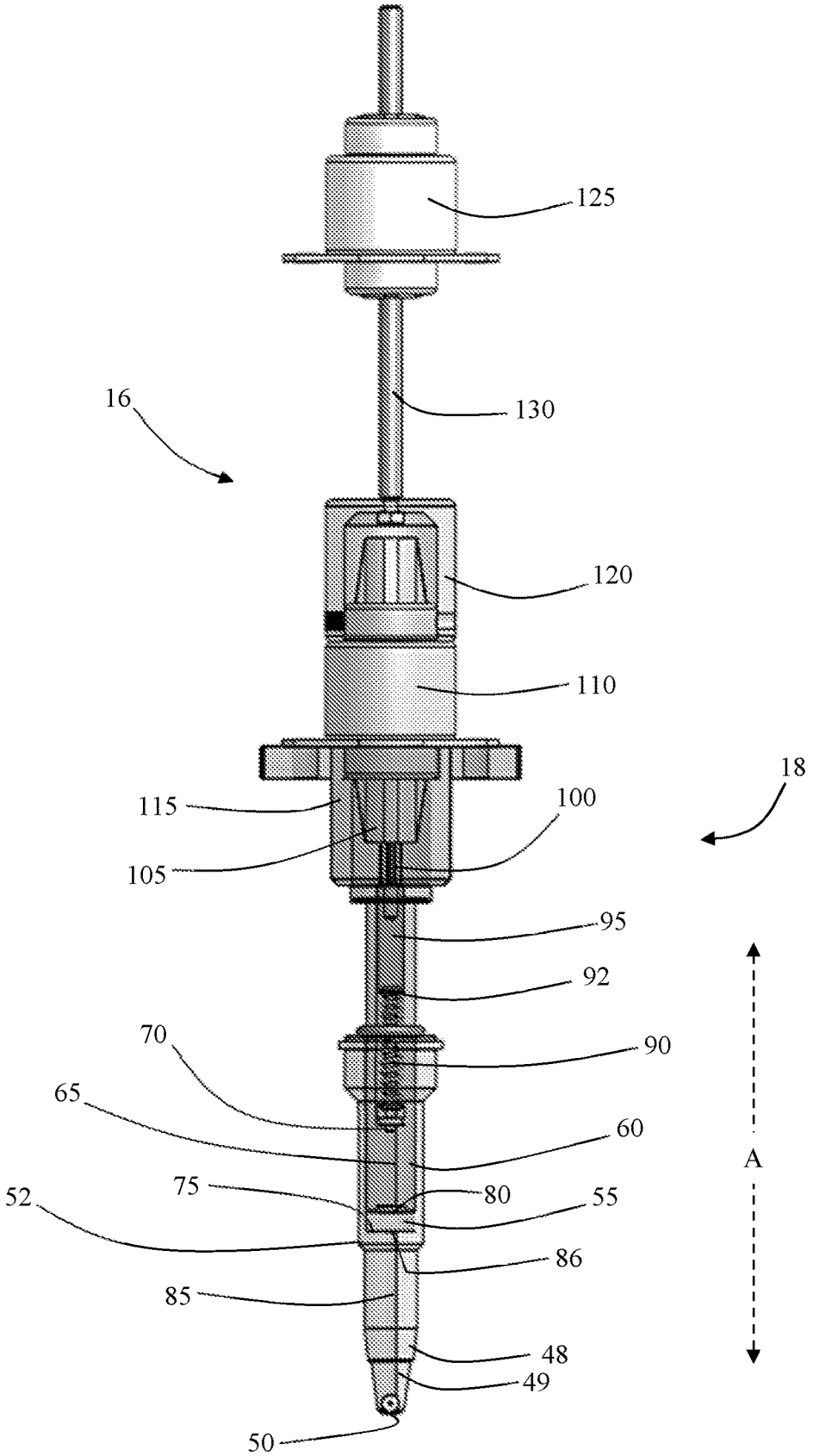
FIG. 2 depicts an embodiment of a motor and piston assembly and fluid displacement system of the pipetting device described herein.

Shown in FIGS. 1A and 2 is an exemplary dispenser housing 52 configured for accommodating a large pipette tip that is capable of aspirating liquid volume in the range from about 10 μl to about 1,500 μl, e.g., about 10 μl, 15 μl, 20 μl, 25 μl, 30 μl, 40 μl, 50 μl, 60 μl, 70 μl, 80 μl, 90 μl, 100 μl, 110 μl, 120 μl, 130 μl, 140 μl, 150 μl, 160 μl, 170 μl, 180 μl, 190 μl, 200 μl, 210 μl, 220 μl, 230 μl, 240 μl, 250 μl, 260 μl, 270 μl, 280 μl, 290 μl, 300 μl, 350 μl, 400 μl, 450 μl, 500 μl, 550 μl, 600 μl, 650 μl, 700 μl, 750 μl, 800 μl, 850 μl, 900 μl, 950 μl, 1,000 μl, 1,100 μl, 1,200 μl, 1,300 μl, 1,400 μl, or 1,500 μl, and a small pipette tip that is capable of aspirating liquid volume in the range from about 0.1 μl to about 200 μl, e.g., about 0.1 μl, 0.2 μl, 0.3 μl, 0.4 μl, 0.5 μl, 1.0 μl, 1.5 μl, 2.0 μl, 2.5 μl, 3.0 μl, 4.5 μl, 5.0 μl, 10 μl, 15 μl, 20 μl, 25 μl, 30 μl, 40 μl, 50 μl, 60 μl, 70 μl, 80 μl, 90 μl, 100 μl, 110 μl, 120 μl, 130 μl, 140 μl, 150 μl, 160 μl, 170 μl, 180 μl, 190 μl, 200 μl. In some embodiments, the first liquid volume range is between about 50 μl and about 1,000 μl, and the second liquid volume range is between about 0.5 μl and about 200 μl. The dispenser housing 52 therefore includes a tiered structure with a large tip holder (also referred to herein as the "first attachment surface") 48 and a small tip holder 49 (also referred to herein as the "second attachment surface"). The tiered structure is such that the outer circumference of the device at the large tip holder portion is wider than the outer circumference at the small tip holder portion. Thus, the tiered design allows for fitting or fastening of tips of different sizes via interference or friction fit, which exploits the circular force of the pipette tip against the tip holder portion of the pipetting device to secure the pipette tip onto the dispenser housing 52, either on the large tip holder 48 or the small tip holder 49. Thus, the pipetting device 10 is capable of aspirating and dispensing a liquid in a range of volumes from between about 0.1 μl to about 1,500 μl, e.g., about 0.1 μl, 0.2 μl, 0.3 μl, 0.4 μl, 0.5 μl, 1.0 μl, 1.5 μl, 2.0 μl, 2.5 μl, 3.0 μl, 4.5 μl, 5.0 μl, 10 μl, 15 μl, 20 μl, 25 μl, 30 μl, 40 μl, 50 μl, 60 μl, 70 μl, 80 μl, 90 μl, 100 μl, 110 μl, 120 μl, 130 μl, 140 μl, 150 μl, 160 μl, 170 μl, 180 μl, 190 μl, 200 μl, 210 μl, 220 μl, 230 μl, 240 μl, 250 μl, 260 μl, 270 μl, 280 μl, 290 μl, 300 μl, 350 μl, 400 μl, 450 μl, 500 μl, 550 μl, 600 μl, 650 μl, 700 μl, 750 μl, 800 μl, 850 μl, 900 μl, 950 μl, 1,000 μl, 1,100 μl, 1,200 μl, 1,300 μl, 1,400 μl, or 1,500 μl. In a particular embodiment, the pipetting device 10 is capable of aspirating and dispensing a liquid in the range of volumes from between about 0.5 μl and about 1,000 μl. As will be explained in more detail below, the device of the present invention is capable of accurately and precisely aspirating and dispensing liquid in such a broad range of volumes due to its dual motor-driven piston and plunger element design.

As one having ordinary skill in the art will appreciate, typical pipettes utilize disposable pipette tips and must be quickly removed and replaced in between the handling of different liquid samples to prevent contamination or unwanted mixture of liquids. Thus, the pipetting device of the instant disclosure may also be designed with an ejector mechanism for quickly and easily removing the pipette tips without the user having to touch the tips themselves.

Figure 1B:
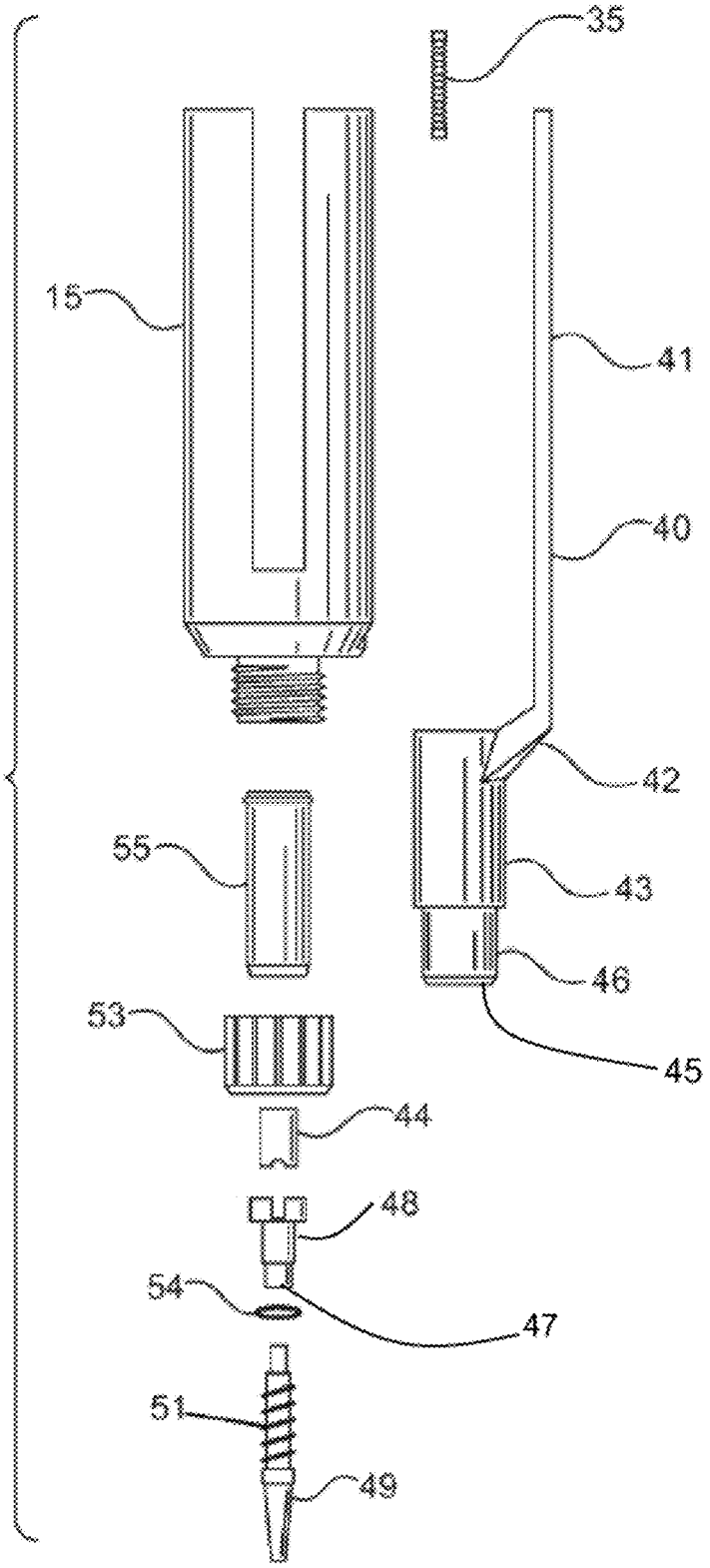
FIG. 1B depicts an embodiment of a multi-tiered tip ejection assembly.

An ejection mechanism suitable for use with the pipetting device of the instant invention includes the multi-tiered spring loaded ejector shown in FIGS. 1A and 1B, which is a single ejection assembly capable of ejecting tips of different sizes and from different points of attachment on the dispensing portion of the pipette. In the embodiment depicted in FIGS. 1A and 1B, the pipetting device 10 has an ejector element 30 (e.g., push button), that is connected to an ejection sleeve 40. A suitable embodiment of an ejection sleeve 40 may include an upper ejection sleeve 41 that runs the approximate length of the pipette housing 15 after which point the upper ejection sleeve 41 tapers 42 to a middle ejection sleeve 43 that includes a mechanical catch element 46 and large tip ejection edge 45 (the upper ejection sleeve 41 and middle ejection sleeve 43 and large tip ejection edge 45, collectively, are also referred to herein as the "upper ejection portion"). The upper ejection sleeve 41 is spring loaded at the top by biasing spring 35 (also referred to as the "first biasing element") to hold the ejection assembly at the highest mechanical position (i.e., an "upward position"), while the sleeve is enabled to be mechanically moved downward against biasing spring 35 by the user. As the ejection sleeve 40 is moved downward, the mechanical catch element 46 contacts the lower ejection sleeve 44 (as shown in FIG. 1B, the lower ejection sleeve 44 is combined with the large tip holder 48 and, together, are also referred to herein as "the lower ejection portion").

The lower ejection sleeve 44 is also spring loaded by biasing spring 51 and held at the highest position. In the case where a large tip is present on the large tip holder 48, the upper ejection sleeve 40 is moved downward until it reaches the point P1 (also referred to herein as the "first position") where it increases tension from the biasing spring 51 (also referred to herein as the "second biasing element") against the lower ejection sleeve 44. This range of movement will cause pressure from the large tip ejection edge 45 to remove the large tip from the large tip holder 48.

In a case where no large tip is present, the user will depress the ejector element 30 until the mechanical catch element 46 engages the lower ejection sleeve 44. At this point the user will continue pressing down, engaging the biasing spring 51 of the lower ejection sleeve 44. The lower ejection sleeve 44 now moves down downward until it reaches the point P2 (also referred to herein as the "second position") and releases the small tip from the small tip holder 49. In this embodiment of the design, the large tip holder 48 doubles as the small tip ejection edge 47 and an O-ring 54 is included to ensure that the large tip holder 48 stays air tight.

In other embodiments, the multi-tiered spring-loaded ejector of the pipetting device includes two separate ejector elements (e.g., buttons), where the user presses either a large tip ejector element or a small tip ejector element depending on whether a large tip is attached to the large tip holder or a small tip is attached to the small tip holder. For instance, the user presses the large tip ejector element to move the ejection sleeve downward and eject the large pipette tip from the large tip holder or presses the small tip ejector element to move the ejection sleeve downward and eject the small tip from the small tip holder. In some embodiments, both the large and small tip ejector elements move the same ejection sleeve—albeit at different distances corresponding to the large and small tip holders. In other embodiments, each of the large tip ejector element and small tip ejector element moves a different ejection sleeve to eject either a large tip or a small tip, respectively.

As mentioned above, the pipetting device of the instant disclosure is enabled to aspirate and dispense a large range of liquid volumes due, in large part, to its motor-driven nested plunger element design, wherein at least one plunger element is slideably received in another plunger element. Movement of each plunger element within its corresponding vacuum chamber creates a vacuum within the chamber that causes an influx of fluid (e.g., air). This fluid displacement facilitates the aspiration of an approximately equivalent volume of liquid into the attached pipette tip. In this manner, each plunger element is capable of adding a vacuum chamber to the device. Each vacuum chamber, in turn, comprises a different volumetric capacity for the inflow of a fluid (e.g., air). In a preferred embodiment, the movement of a plunger element within its vacuum chamber will create a vacuum that causes a displacement of air. In other words, the air will rush into the vacuum chamber. This displacement of air causes a corresponding volume of liquid to be aspirated into the tip attached to the end of the device.

Moreover, the arrangement of nested plunger elements of decreasing cross-sectional area creates vacuum chambers of deceasing volumetric capacity. For instance, one plunger element will include an interior space or bore through which another, smaller plunger element is slideably received or positioned. Thus, as this smaller plunger element moves up and down within the larger plunger element, it creates another vacuum chamber, albeit with a smaller volumetric capacity. Therefore, the pipetting device described herein allows for rapid and dynamic switching from one vacuum chamber to another simply by operating different plunger elements thereby enabling the device to precisely and accurately dispense a larger range of liquid volumes as compared to devices currently on the market. While the pipetting device disclosed herein can have any number of nested plunger elements and vacuum chambers, the non-limiting, exemplary embodiments shown in FIGS. 1A-8D have two plunger elements and two vacuum chambers. In a preferred embodiment, the plunger elements are cylindrical.

In a preferred embodiment, the pipetting device includes at least two plunger elements, with one of the plunger elements being slidably received within the other plunger element to create a nested or concentric plunger element arrangement. In particular, the pipetting device will include a large plunger element (also referred to herein as the "first plunger" or "first plunger element") that slides within a vacuum chamber in the housing (also referred to herein as the "first vacuum chamber") as well as a small plunger element (also referred to herein as the "second plunger" or "second plunger element") that is slideably received within a receptacle or bore in the large plunger element to create another, smaller vacuum chamber (also referred to herein as the "second vacuum chamber"; see, for example, FIGS. 2-4). Movement of the plunger elements are controlled by motor-driven actuation of pistons within the device. Movement of the plunger elements will control the volumetric capacity of the corresponding vacuum chambers, which, in turn, control the amount of fluid (e.g., air) displaced by the vacuum chamber. Finally, the fluid displacement causes the aspiration of an approximately equivalent volume of liquid into the pipette tip. It is preferred that the movement of the plunger elements will be controlled by a set of motor-driven pistons housed within the drive section of the device.

As discussed above, in order to create a nested plunger design with distinct vacuum chambers of different volumetric capacities, it is preferred that the plunger elements be cylindrical in shape with different cross-section diameters. For instance, in one embodiment, the cross-section diameter of the large plunger element is typically between about 3 mm and about 20 mm, e.g., 3 mm, 4 mm, 5 mm, 6 mm, 7 mm, 8 mm, 9 mm, 10 mm, 11 mm, 12 mm, 13 mm, 14 mm, 15 mm, 16 mm, 17 mm, 18 mm, 19 mm or 20 mm. In preferred embodiments, the cross-section diameter of the large plunger element is between about 5 mm and about 15 mm; more preferably, it is between about 6 mm and about 10 mm. For instance, in one particular embodiment, the cross-section diameter of the large plunger element is about 7 mm to about 8 mm. For the small plunger element, the cross-section diameter can be between about 0.5 mm and about 5 mm, e.g., 0.5 mm, 0.6 nm, 0.7 mm, 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, 2.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm, 4.5 mm, 4.6 mm, 4.7 mm, 4.8 mm, 4.9 mm, or 5.0 mm; provided, however, that the cross-section diameter of the small plunger element is less than the cross-section diameter of the large plunger element to allow for the nested arrangement. In some embodiments, the cross-section diameter of the small plunger element is between about 1 mm and about 3 mm. For instance, in one particular embodiment, the cross-section diameter of the small plunger element is about 1.4 mm to about 1.7 mm.

The nested plunger arrangements suitable for use in the present design will have a ratio of small plunger element cross-section diameter to large plunger element cross-section diameter that ensures efficient fluid displacement in a hand-held pipette while still allowing for a lightweight and compact design. In some embodiments, the ratio of the diameter of the small plunger element to the diameter of the large plunger element be 1:1.1 to 1:40, e.g., 1:1.1, 1.1.5, 1:2, 1:2.5, 1:3, 1:3.5, 1:4, 1:4.5, 1:5, 1:5.5, 1:6, 1:6.5, 1:7, 1:7.5, 1:8, 1:8.5, 1:9, 1.9.5, 1:10, 1:15, 1:20, 1:25, 1:30, 1:35, and 1:40. In other embodiments, the ratio of the diameter of the small plunger element to the diameter of the large plunger element is 1:2 to 1:10. For instance, in one particular embodiment, the ratio is 1:5.

The nested plunger configuration and function will now be described in more detail. As shown in FIGS. 2, 3, 4A, and 4B, the drive section 12 includes the motor assembly 16 (also referred to herein as the "electronic drive unit"), which is encased in the pipette housing 15. The motor assembly 16 is connected to the large plunger assembly 18 via an attachment element 115.

The attachment element 115 has a pair of motor assembly anchors 160 that can be attached to the motor assembly 16 with screws (e.g., via the screw holes 162), nails, adhesive and the like. The large plunger element 60 is attached to the attachment element 115 and partially disposed within the dispenser housing 52. The dispenser housing 52 includes a bore or fluid passageway 85 through its center and an inlet 50 for receiving a fluid from the external environment, such as a liquid or gas (e.g., air). The large plunger element 60 is slideably received within the bore or fluid passageway in the dispenser housing 52. The movement of the large plunger element 60 within the dispenser housing 52 creates a large vacuum chamber 55.

Shown in FIG. 2 is a typical arrangement in which the large plunger element 60 and the dispenser housing 52 are oriented vertically. The large plunger element is configured for movement along this vertical axis A. The large plunger element 60 is capable of being moved or actuated between a closed position and an open position. In the closed position, the large plunger element will be at the bottom of its axis of movement (i.e., at the fluid inlet 86 (also referred to herein as the "first fluid inlet") of the dispenser housing 52). As such, the end 145 of the large plunger element 60 will make contact with the seat 75 within the interior of the dispenser housing 52 and at the bottom of the large vacuum chamber 55. In the embodiment depicted in FIGS. 2, 4A and 4B, an O Ring 56 may be nested into the bottom of the large plunger element 60 to ensure the seal is air tight. In the open position, the large plunger element 60 will be moved towards the top of its axis of movement. In the open position, the large plunger element 60 will move away from seat 75 thereby increasing the volume of the large vacuum chamber 55. When the large plunger element 60 is in the fully open position and at the top of its axis of movement, the large vacuum chamber 55 will be at maximum volume. When the large plunger element 60 is in the open position, air can be displaced from the external environment into the large vacuum chamber 55 via fluid inlet 86 in the floor of the large vacuum chamber 55.

Figure 4A:
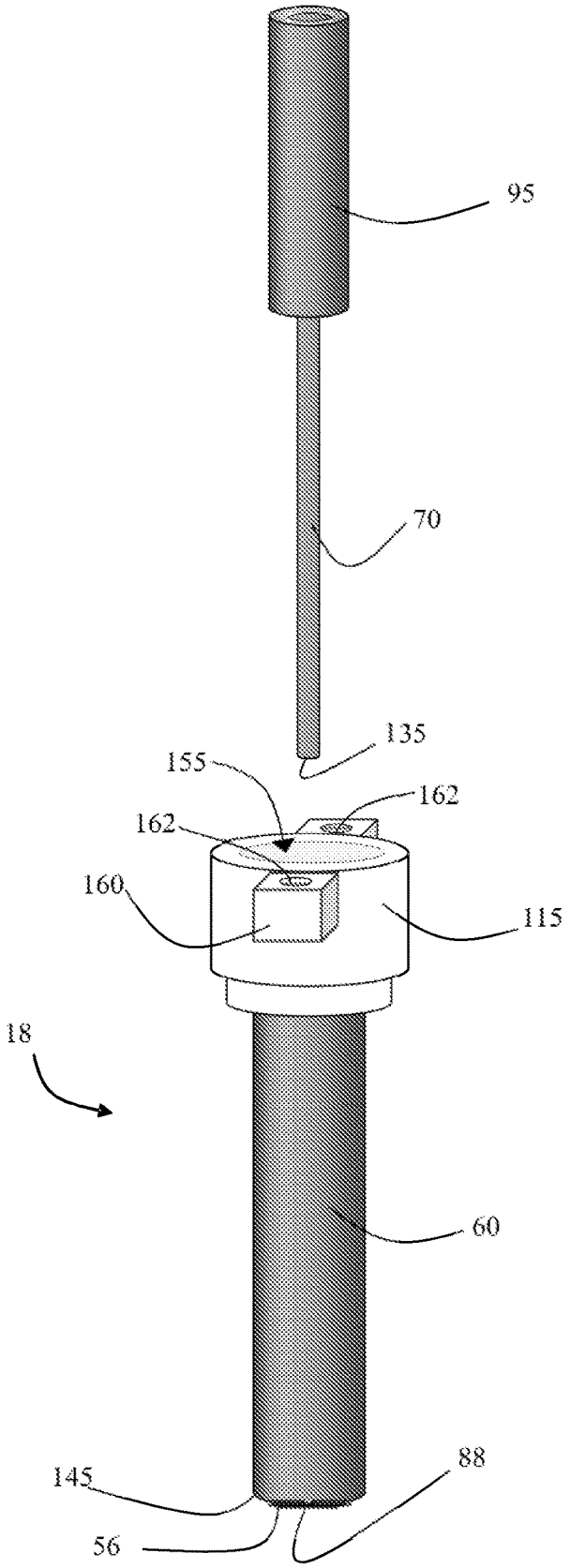
FIG. 4A depicts an embodiment of the large plunger element and small plunger element.
Figure 4B:
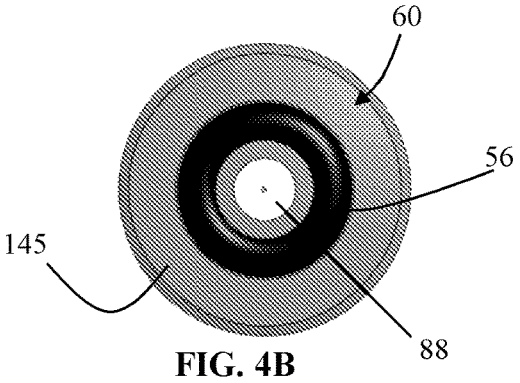
FIG. 4B is a bottom view of the large plunger element.

In a preferred embodiment, the large plunger element 60 will also have an interior space or passage 155 with an opening 88 (also referred to herein as the "second fluid inlet") at the end 145 for receiving a fluid, such as air (see FIGS. 2, 4A, and 4B). In such embodiment, a small plunger element 70 and large plunger element 60 are nested such that the small plunger element 70 can be slideably received with the interior space or passage 155 in the large plunger element 60, and the movement of the small plunger element 70 within the large plunger element 60 along vertical axis A creates a small vacuum chamber 65. As such, the small plunger element 70 will necessarily have a cross-sectional area that is smaller than the cross-sectional area of the large plunger element 60. In this embodiment, the small plunger element 70 is typically solid (i.e., does not have an interior fluid passageway). However, in embodiments with three or more vacuum chambers, the small plunger element 70 may have an interior space for slideably receiving yet another plunger element.

The small plunger element 70 is also capable of moving between a closed position and an open position. In the closed position, the small plunger element 70 will be at the bottom of its axis of movement (i.e., at the opening 88 of the large plunger element 60). As such, the end 135 of the small plunger element 70 will make contact with the seat 80 within the interior of the large plunger element 60 and at the bottom of the small vacuum chamber 65. Therefore, displaced air cannot enter into the small vacuum chamber 65. In the open position, the small plunger element 70 will be moved towards the top of its axis of movement. In the open position, the small plunger element 70 will move away from seat 80 thereby increasing the volume of the small vacuum chamber 65. Therefore, displaced air can enter into the small vacuum chamber 65 through the fluid inlet 88 in the large plunger element 60.

In some embodiments, the device has an O-ring 140 at the end of the small plunger element 70 to ensure a good seal when the small plunger element 70 is in the closed position.

Further, a biasing spring 90 can be used to bias the small plunger element 70 towards the open position. When the small plunger element 70 is in the fully open position and at the top of its axis of movement, the small vacuum chamber 65 will be at maximum volume. When the small plunger element 70 is in the closed position, the small vacuum chamber 65 is also closed wherein fluid, such as air, does not enter the small vacuum chamber 65.

In a preferred embodiment, when the large plunger element 60 is open, the small plunger element 70 will be closed to prevent displaced air from moving into the small vacuum chamber 65 from the large vacuum chamber 55. Similarly, when the small plunger element 70 is open, the large plunger element 60 will be in the closed position to prevent displaced air from moving into the large vacuum chamber 55. When the large plunger element 60 is in the closed position, the displaced air will travel directly from the fluid inlet passage 85 through the inlets 86, 88 and into the small vacuum chamber 65, which is disposed within the interior of the large plunger element (see FIG. 2). A small O Ring 56 may be nested into the bottom of the large plunger to ensure the air passage for the small plunger is air tight when the large plunger is closed.

While manual actuation designs are contemplated, the preferred design of the present pipetting device utilizes an electronic motor drive system to actuate the plunger elements. In particular, the device may have separate electric motors configured to actuate each plunger element. In a preferred embodiment, the pipetting device has dual motors for actuating each of two nested plunger elements. The motors, in turn, respond to a control system operated by the user via an interface. In some embodiments, the plunger elements are connected directly to the motors. In other embodiments, each motor actuates a piston, which is connected to the plunger element. Suitable motors include, but are not limited to, servo motors, stepper motors, and linear actuator motors. In a particular embodiment, the plunger elements are actuated by a stepper motor, such as a can stack stepper motor, which is also referred to as a can stack linear actuator motor. Each plunger can be actuated by the same type of motor, or by different types of motors.

Figure 3:
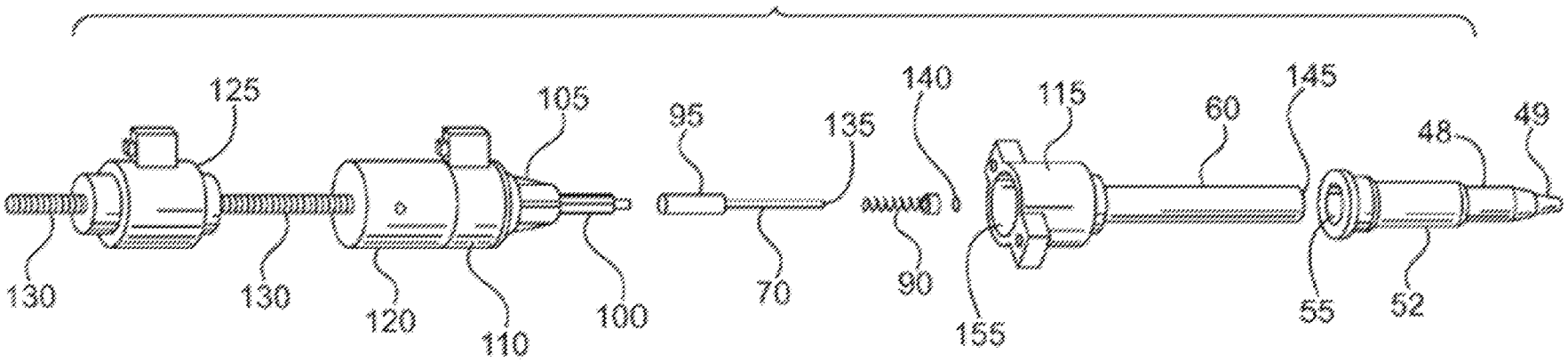
FIG. 3 is a disassembled view of an embodiment of a motor assembly and fluid displacement system of the pipetting device described herein.

FIGS. 2 and 3 illustrate an embodiment of the invention that utilizes dual-motor driven pistons to actuate the plunger elements. As shown in FIGS. 2 and 3, the small plunger element 70 is connected to the small volume piston 95 (also referred to herein as the "second piston"), which is connected by the piston receiver 105 to the small piston motor 110 (also referred to herein as the "second motor") via the connecting element 100 (e.g., via threadably mated). The small piston 95, connecting element 100, and small plunger element 70 are configured for actuable movement along axis A in response to the metering of the small piston motor 110. The small piston motor 110 is also connected to the large volume piston 130 (also referred to herein as the "first piston") by way of motor connector element 120. In this fashion, the large volume piston 130, the motor connector element 120, the small piston motor 110, the small volume piston 95, small plunger element 70, and large plunger element 60 move as a single unit when the large volume piston 130 is actuated in response to the metering of the large piston motor 125 (also referred to herein as the "first motor").

In one embodiment, suitable motors are can stack stepper motors or can stack linear actuator motors. These motors move a piston in a straight line with no rotation. Each of these motors is connected to a controller board that can independently move each motor during a pipetting action or move them in tandem.

Figure 5B:
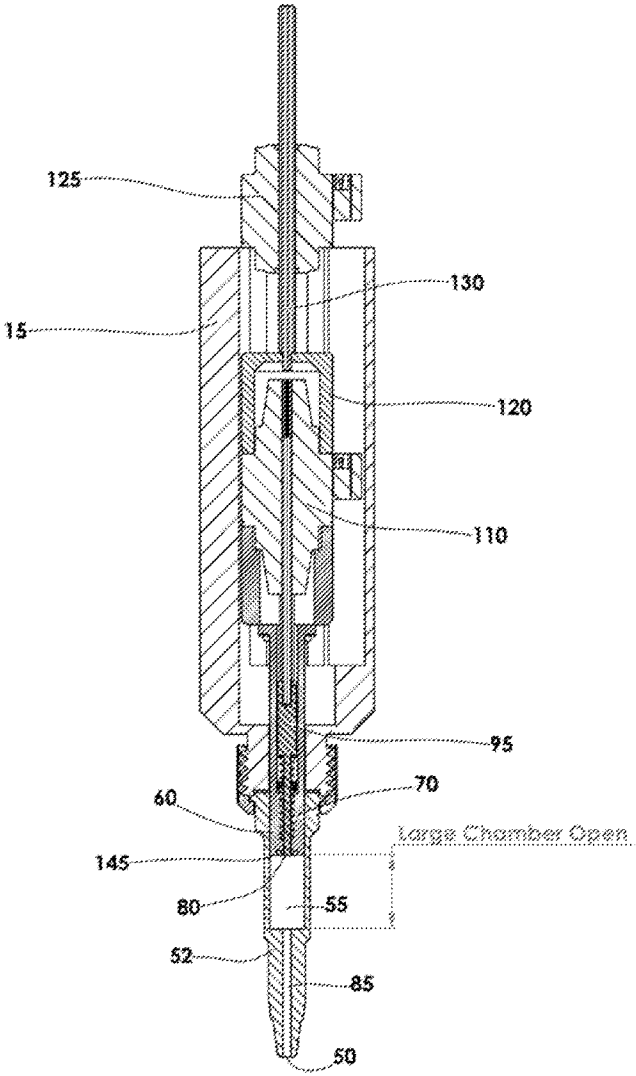
FIGS. 5A-5D illustrate an embodiment of the pipetting device in operation.
Figure 5A:
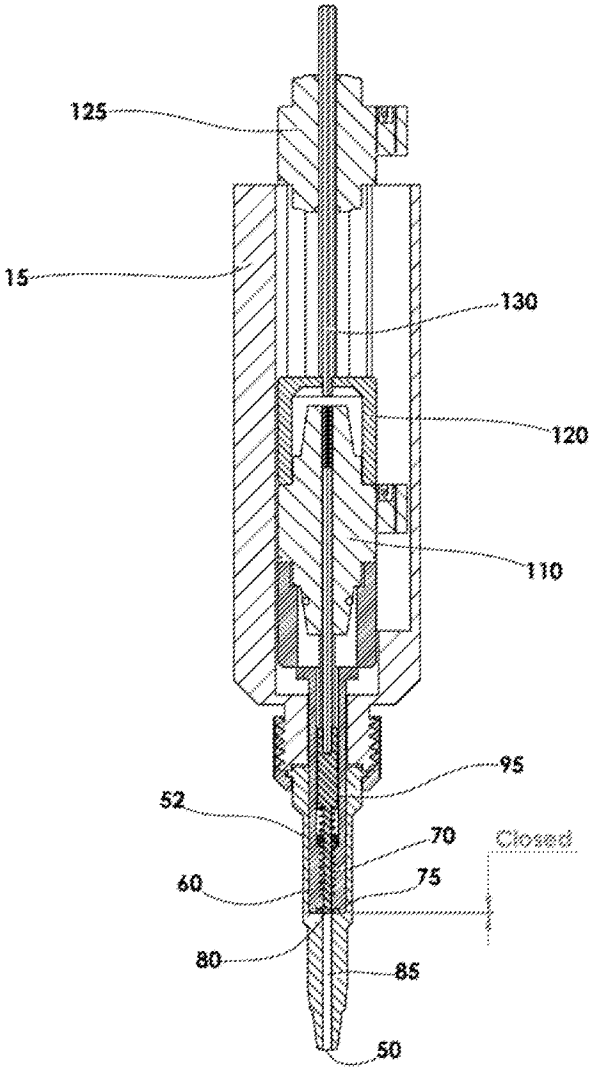

The operation of the pipetting device is illustrated in FIGS. 5A-5D. FIGS. 5A and 5B demonstrate the aspiration and dispensing of large volumes of liquid (e.g., about 50 μl to about 1,000 μl). When dispensing large volumes, the user may attach a large pipette tip (e.g., configured for dispensing volumes in the range from about 50 μl to about 1,000 μl) onto the end of the dispenser housing using an interference fit as described above. When operating the device for aspiration of large volumes, the small plunger element 60 is in the closed position with the end 135 of the small plunger element 70 making contact with the seat 80 within the large vacuum chamber 55. The O-ring 140 ensures an air-tight seal to prevent leakage of fluid (e.g., air) into the small vacuum chamber 65. In other words, it can be said that the small plunger element has "bottomed out." In FIG. 5A, the large plunger element 60 is in contact with the seat 75 of the large vacuum chamber 55. Thus, the large plunger element 60 is also "bottomed out." In other words, both the plunger elements are in the closed position. When both elements are in the closed position, no air is displaced from the external environment into either vacuum chamber 55, 65.

The user inputs the desired dispensing volume via an interface consisting of knobs and or buttons with feedback given via an LCD screen. For instance, as one having ordinary skill in the art would understand, the actuator element 20 may be configured for volume adjustment by rotation by the user with feedback given via an LCD screen. This input is communicated to a controller printed circuit board (PCB) within the head of the pipette that is attached via a power and communication cable to the motors. The PCB will be programmed to store the range at which each motor operates—a small volume range for the motor that controls the small motor, and a large volume range for the motor that controls the large plunger. When using a volume in the large volume range, the user attaches a large pipette tip to the large pipette tip holder 48, inputs the desired volume to be aspirated, and places the end of the large pipette tip into the liquid that will be aspirated.

After setting the desired volume to be aspirated (in the large volume range), the user presses a button on the top surface 25 of the pipette, which, in turn sends a signal to the large motor to move up to a position that will draw in the appropriate volume of liquid. The large piston motor 125 then moves the large volume piston 130 upwards. As the large piston 130 moves upwards, it moves the motor connector element 120, small piston motor 110, and large plunger element 60 upwards at the same time and as one unit. As the large plunger 60 moves upwards along axis A and away from the seat 75 of the large vacuum chamber 55, the volumetric capacity of the large vacuum chamber 55 increases thereby creating a vacuum which causes the corresponding displacement of air through the fluid inlet 50. The air moves up the fluid passage 85 of the dispenser housing 52, through the fluid inlet 86 and into the large vacuum chamber 55. In turn, the corresponding volume of liquid is aspirated into the pipette tip. The user then presses the actuator element 20 a second time, which causes the downward movement of the large volume piston 130 and large plunger element 60. As the large plunger element 60 moves downward, it forces the displaced air back out of the fluid inlet 50, which dispenses the liquid out of the pipette tip.

In the particular embodiment shown in FIG. 5B, the small plunger element 70 will be in the closed position such that the bottom end 135 contacts the seat 75 within the large plunger element 60. Therefore, the displaced air from the large vacuum chamber 55 cannot enter the small vacuum chamber 65 through the fluid inlet 88 of the large plunger. In some embodiments, the device includes a sealing member, such as O-ring 140 (see, e.g., FIG. 3) to prevent leakage of displaced air into the small vacuum chamber.

In some embodiments, it will be desirable to eject the pipette tip after dispensing the fluid and replace the tip with a new one. The pipetting device described herein may include an ejection mechanism, such as the multi-tiered spring loaded ejector mechanism described in FIG. 1B. In this particular embodiment, the user will push down on the ejector element 30, which moves the ejection sleeve 40 downward as the mechanical catch element 46 contacts the lower ejection sleeve 44. If a large tip is present on the large tip holder 48, the upper ejection sleeve 40 is moved downward until it reaches the point of contact where tension from the biasing spring 51 against the lower ejection sleeve 44 causes pressure from the large tip ejection edge 45 to remove the large tip from the large tip holder 48.

The user then replaces the pipette tip by inserting the end of the dispenser housing into the top opening of a pipette tip and using a downward force to attach the pipette tip to the pipetting device by way of an interference or frictional fit. In some embodiments, the user may desire to decrease the dispensing volume such that the smaller tip (e.g., configured for dispensing volumes in the range from about 1 μl to about 200 μl) is fastened to the end of the dispensing housing.

Figure 5D:
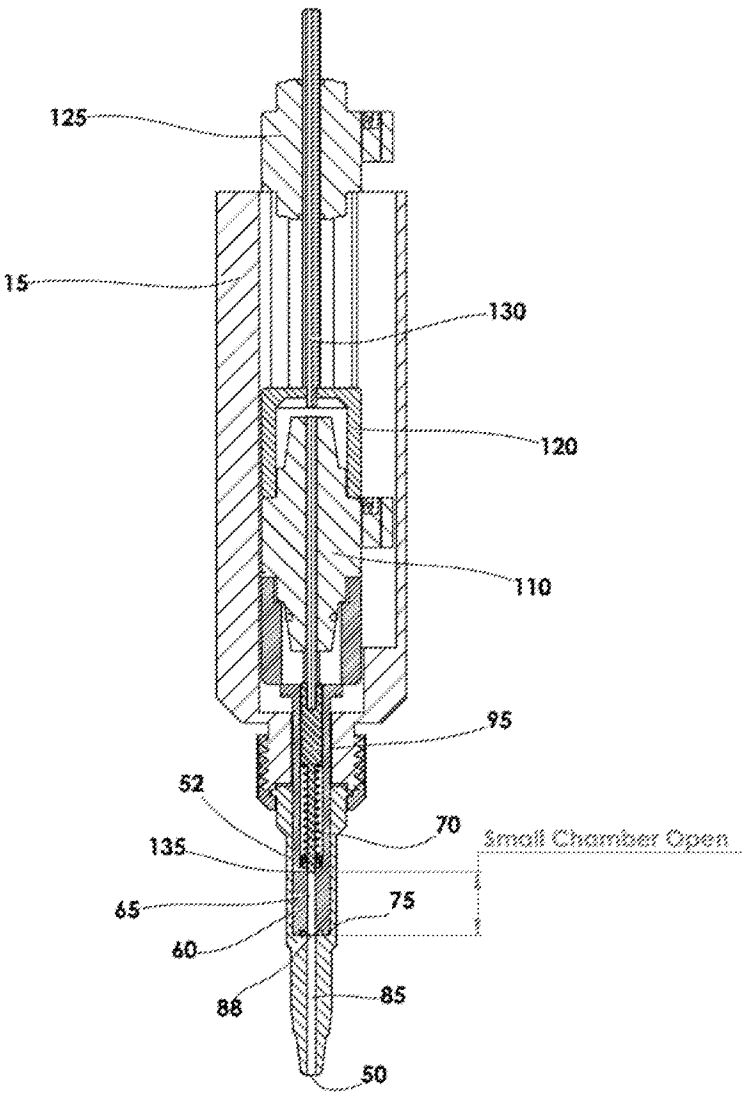
Figure 5C:
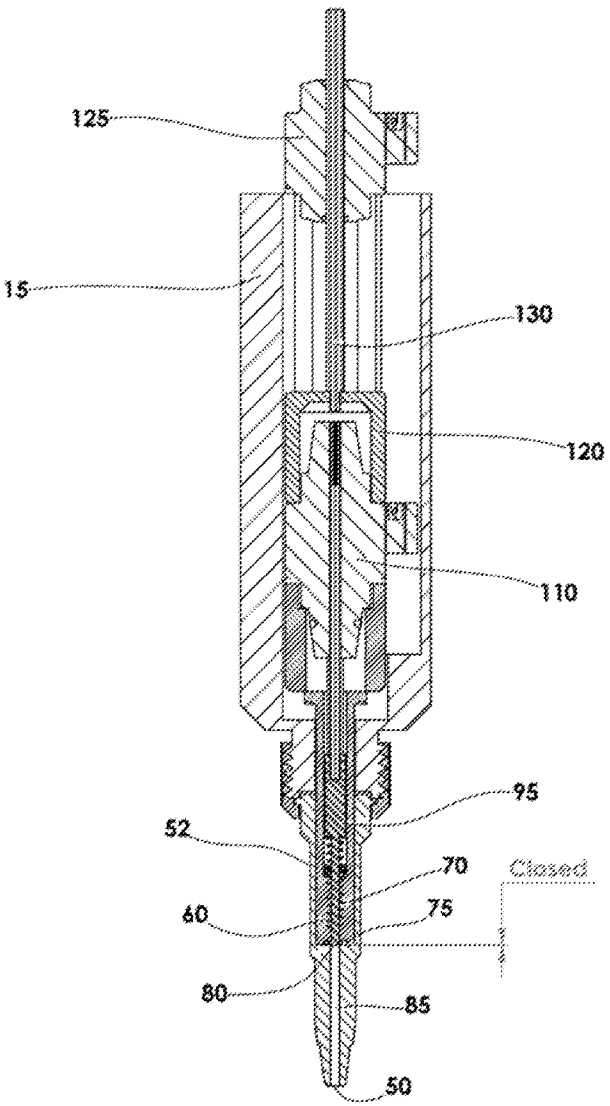

FIGS. 5C and 5D demonstrate the aspiration and dispensing of small volumes of liquid (e.g., about 1 μl to about 200 μl). As shown in FIG. 5C, the small plunger element 70 and the large plunger element 60 are "bottomed out" or in the closed position. The user attaches a small pipette tip to the small pipette tip holder 49 and places the end of the small pipette tip into the liquid that will be aspirated. The device can be switched from the large volume range to the small volume range via the user interface. In preferred embodiments, the pipetting device will not include a physical switch, since the resting position is identical whether the pipette is in large volume mode or small volume mode. Thus, in preferred embodiments, when a user selects a volume that is in the small volume range, the firmware will be instructed to only move the small motor/plunger mechanism. Conversely, when a volume in the large range is selected, the large motor and plunger will be engaged. Accordingly, in preferred embodiments, this process will be seamless to the user. In some aspects, the interface associated with the control system will include the option for the user to program one or more preset volumes to enable the user to quickly switch between the preset volumes.

Once the desired volume in the small volume range is set, the user presses the top surface 25 of the actuating element 20, which, in turn, sends a signal to the small piston motor 110 to move the small volume piston 95 upwards to a position that will draw in the appropriate volume of liquid that the user had specified. As shown in FIG. 5D, as the small volume piston 130 moves upwards, it moves the small plunger element 70 upwards along axis A and away from the seat 80 of the small vacuum chamber 65. Thus, the small plunger element 70 transitions from the closed position towards the open position. While the small plunger element 70 moves towards the open position, the volumetric capacity of the small vacuum chamber 65 increases thereby creating a vacuum and causes the corresponding displacement of air through the fluid inlet 50 and into the small vacuum chamber 65 via the fluid inlet 88 in the large plunger element 60. In turn, an approximately equivalent volume of liquid is aspirated into the pipette tip. The user then presses the actuator element 20 a second time, which causes the downward movement of the small volume piston 95 and small plunger element 70. As the small plunger element 70 moves downward against biasing spring 90, it forces the displaced air back out of the fluid inlet 50, which dispenses the fluid out of the pipette tip.

To eject the small pipette tip, the user will depress the ejector element 30 until the mechanical catch element 46 of the middle ejection sleeve 43 engages the lower ejection sleeve 44. At this point the user will continue pressing down, engaging the biasing spring 51. The lower ejection sleeve 44 now moves down and releases the small tip from the small tip holder 49.

When the small plunger element is in operation, the large plunger element will remain in the closed position with its end 145 in contact with the seat 75 on the floor of the large vacuum chamber 55. An O Ring 56 is nested into the bottom of the large plunger to keep the small volume chamber air tight. Thus, displaced air flowing up the passage 85 will flow directly through the fluid inlets 86, 88 and into the small vacuum chamber 65 without leaking into the large vacuum chamber 55.

Figure 6A:
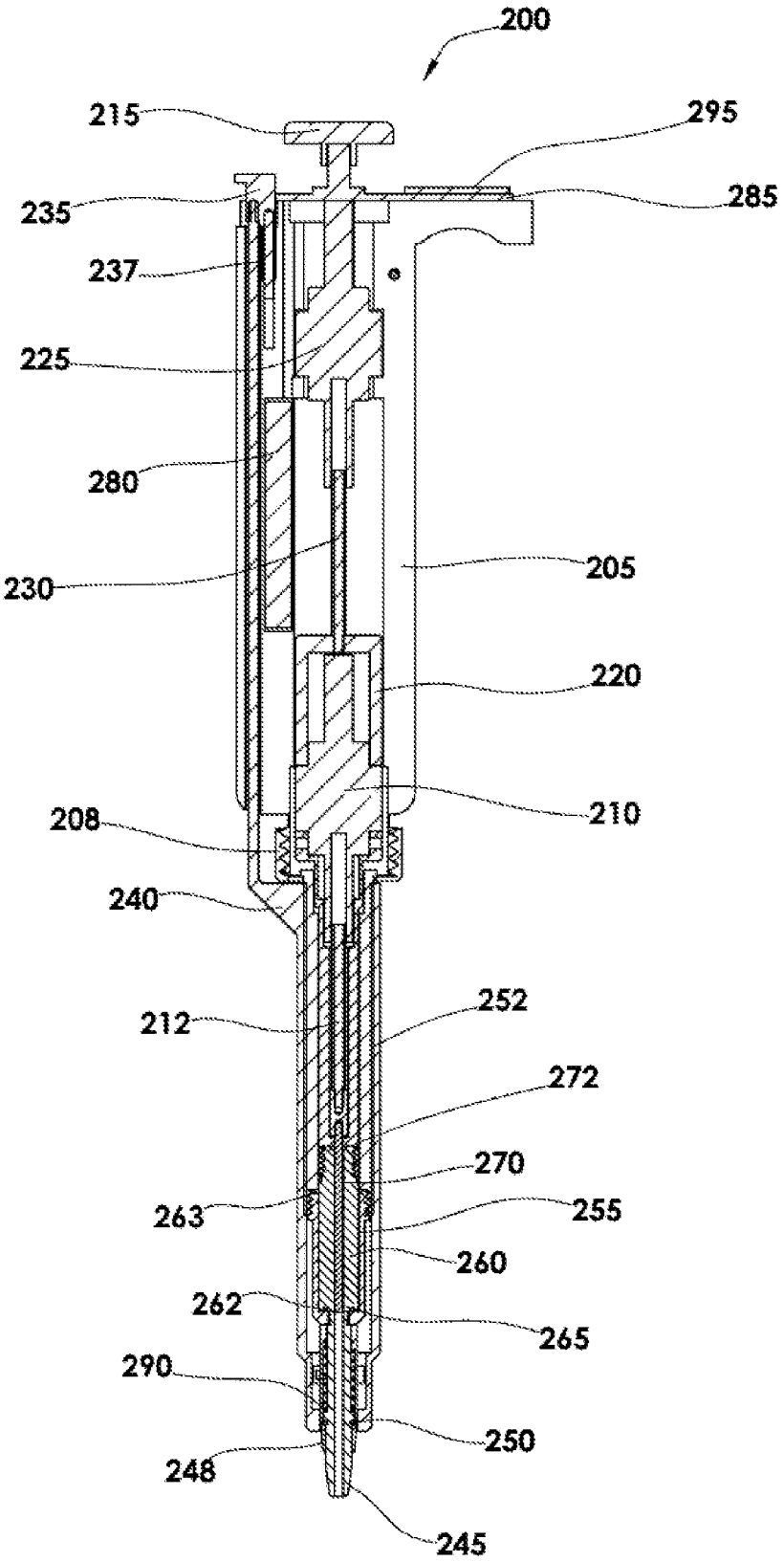
FIGS. 6A-6E illustrate another embodiment of the pipetting device.
Figure 6B:
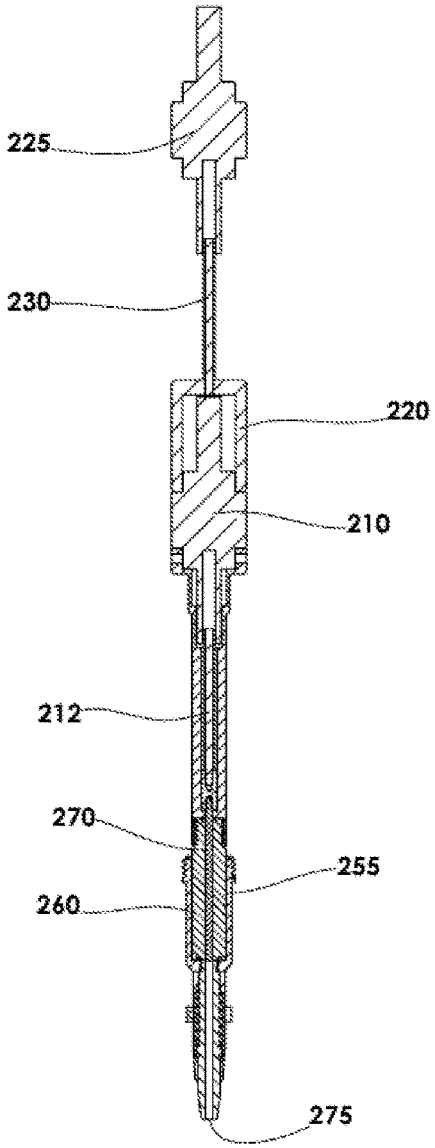
Figure 6C:
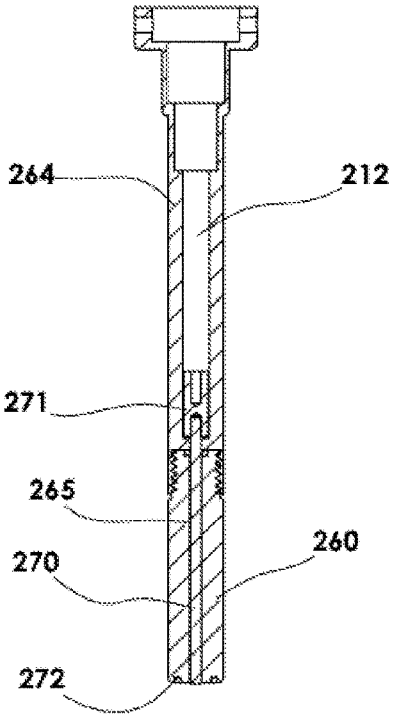
Figure 6D:
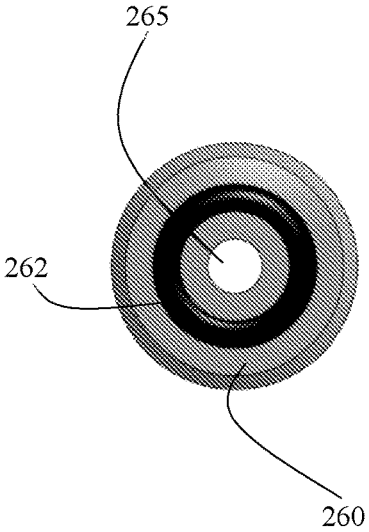

FIGS. 6A-6E depict another embodiment of the pipetting device with an LCD screen and rechargeable battery. The pipetting device 200 also includes the inline dual motor driven piston and dispensing system arrangement as described above with respect to FIGS. 1-5 and functions in substantially the same manner. As shown in FIGS. 6A and 6B, the upper pipette housing 205 contains the electronic drive unit and is connected to a dispenser housing 252 by a housing nut 208. Within the dispenser housing is the fluid displacement system, substantially the same as described above. Within the upper pipette housing 205 is the large piston motor 225 ("first motor"), large volume piston 230 ("first piston"), motor connection element 220, and small piston motor 210 ("second motor"). The small piston motor 210 is attached to a plunger connection element 264, which is connected to the large plunger element 260 ("first plunger"). The small piston motor 210 is attached to a small volume piston 212 ("second piston"), which is connected to the small plunger element 270 ("second plunger") by a connector 271. The majority of the small plunger element 270 and large plunger element 260 are contained within the dispenser housing 252.

The large plunger element 260 moves within a large vacuum chamber 255 ("first vacuum chamber"). The large plunger element 260 includes a cylindrical bore or small vacuum chamber 265 ("second vacuum chamber") within which the small plunger element 270 is slideably received thereby forming the nested plunger arrangement. A set of O-rings 250, 262, 263, and 272 can be included to prevent leakage of air between the vacuum chambers and connection points. For example, the O-ring 262 at the bottom of the large plunger element 260 (see FIG. 6D) prevents leakage of air into the large vacuum chamber 255 when the large plunger element 260 is in the fully closed or "bottomed out" position. The pipetting device 200 includes both a small tip holder 245 and a large tip holder 248 onto which the user can attach the desired disposable pipette tip via interference or restriction fit as described above.

Figure 6E:
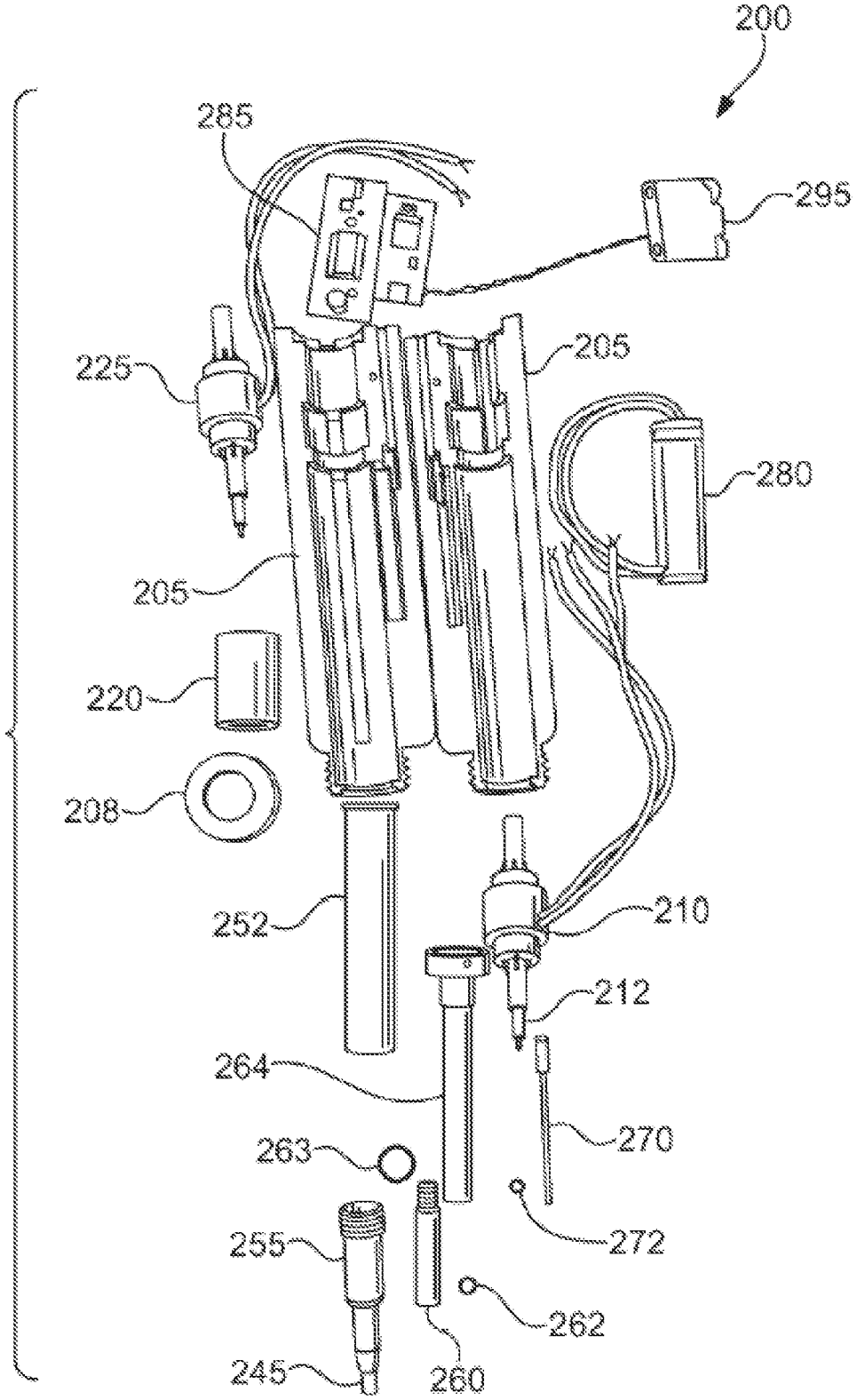

Also depicted in FIGS. 6A and 6E is a rechargeable battery 280 within the upper housing 205 to power the piston motors 210, 225 of the pipetting device 200 without the need to plug the device into an external outlet or other power source. The user inputs the desired dispensing volume by turning/rotating the actuating element/volume control 215 or, in some embodiments, by inputting the desired volume via an LCD screen 295 interface. In either design, a feedback readout is displayed via the LCD screen 295. The volume input is communicated to an instrument control PCB 285 that is in electronic communication with and signals the motors of the device.

In operation, the pipetting device 200 works in much the same way as the pipetting device 100 shown in FIGS. 1-5. While in the large volume range (e.g., about 50 μl to about 1,000 μl or more), the user presses the actuating element/volume control 215, which, in turn, sends a signal via the instrument control PCB 285 to the large piston motor 210 and moves the large volume piston 230 upwards together with the motor connection element 220, small piston motor 225, and large plunger element 260. As the large plunger element 260 moves upwards within the large vacuum chamber 255, the volumetric capacity of the large vacuum chamber increases and creates the vacuum necessary to cause a corresponding displacement of air into the fluid inlet 275, which air displacement draws a corresponding volume of liquid into the pipette tip. The user then presses the actuating element/volume control 215 a second time to cause the downward movement of the large plunger element 260 and dispensing of liquid out of the pipette tip. While in the small volume range (e.g., about 1 μl to about 100 μl), both the large plunger element 260 and small plunger element 270 are "bottomed out" to the closed position. When the user presses the actuating element/volume control 215, a signal is sent via the instrument control PCB 285 to the small piston motor 225, which moves the small volume piston 212 and small plunger element 270 upwards. As the small plunger element 270 moves upwards within the small vacuum chamber 265, it creates the vacuum necessary to cause a corresponding displacement of air into fluid inlet 275, which air displacement draws a corresponding volume of liquid into the pipette tip. The user then presses the actuating element/volume control 215 a second time to cause the downward movement of the small plunger element 270 and dispensing of liquid out of the pipette tip.

The pipetting device 200 further includes a multi-tiered spring loaded tip ejector mechanism. This mechanism comprises an ejector element 235, large tip ejector biasing spring 237, large tip ejector sleeve 240, small tip ejector biasing spring 290. The functionality of the multi-tiered spring loaded tip ejector mechanism is described in detail above.

Figure 7:
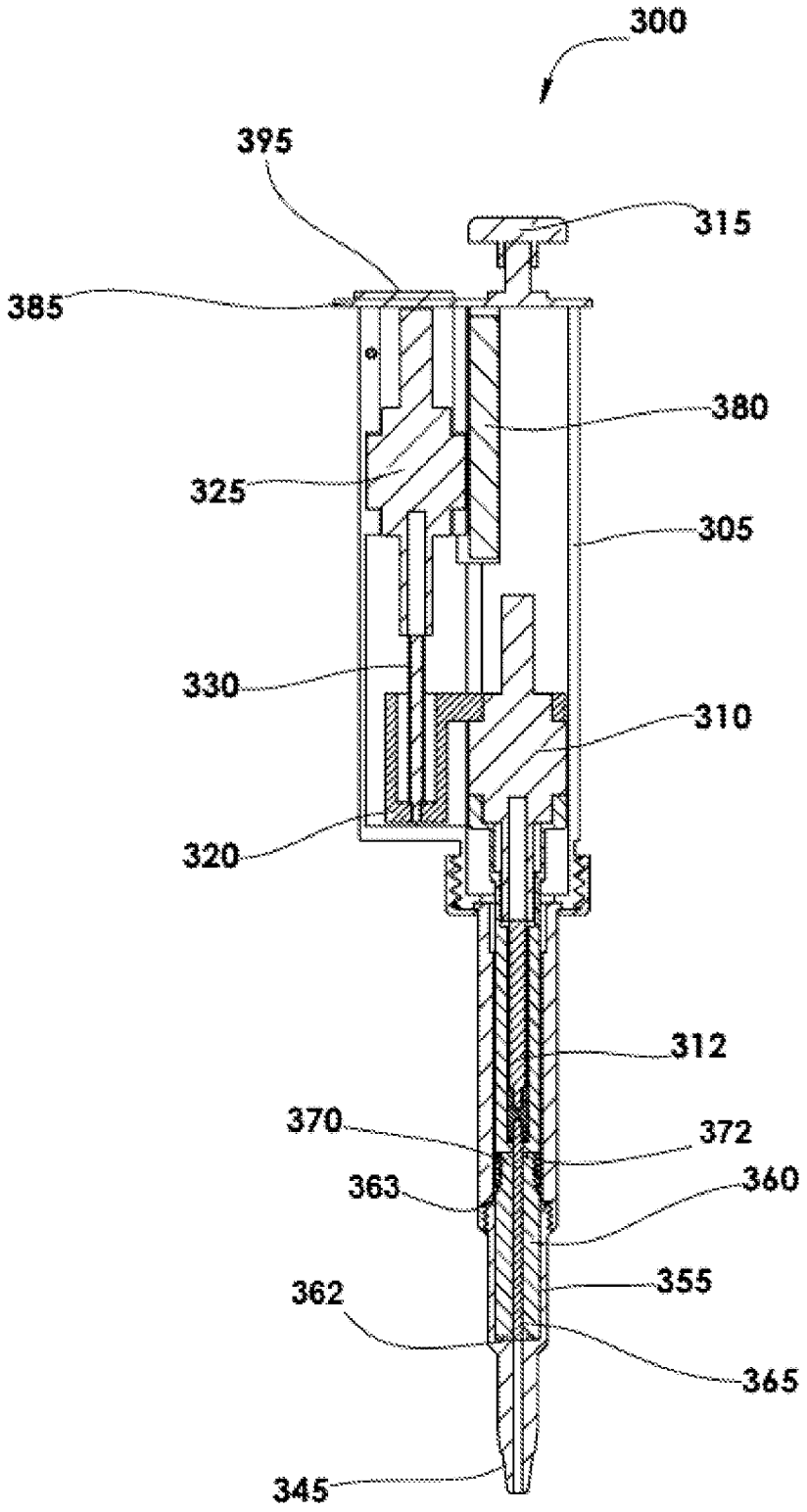
FIG. 7 depicts a side view of an embodiment of a pipetting device with a cantilever motor connection element.
Figure 8B:
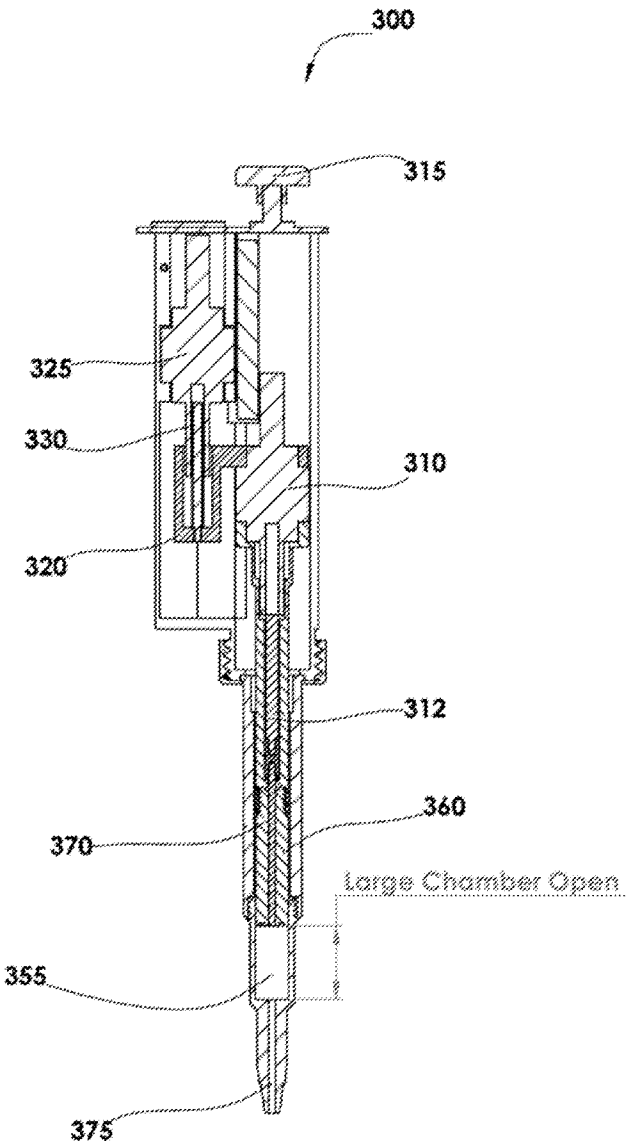
FIGS. 8A-8D illustrate an embodiment of the pipetting device with the cantilever design in operation.
Figure 8A:
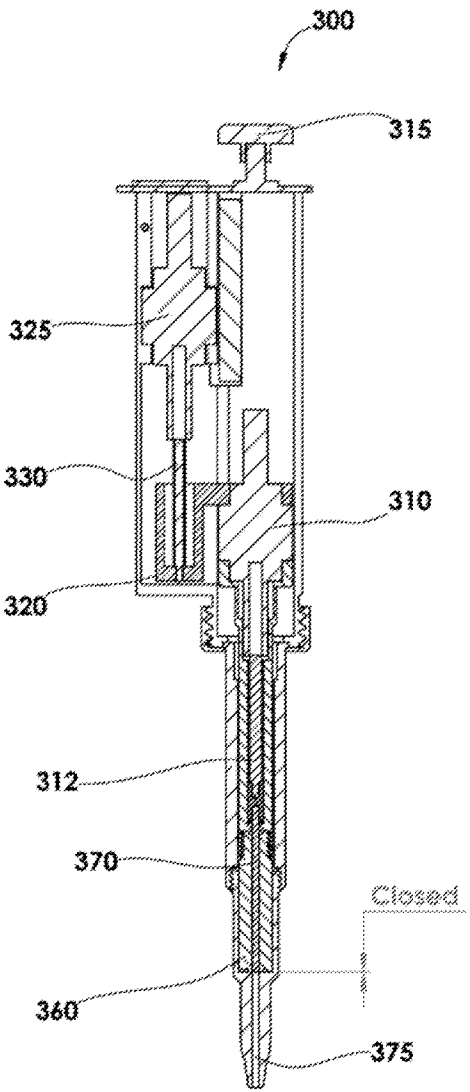
Figure 8D:
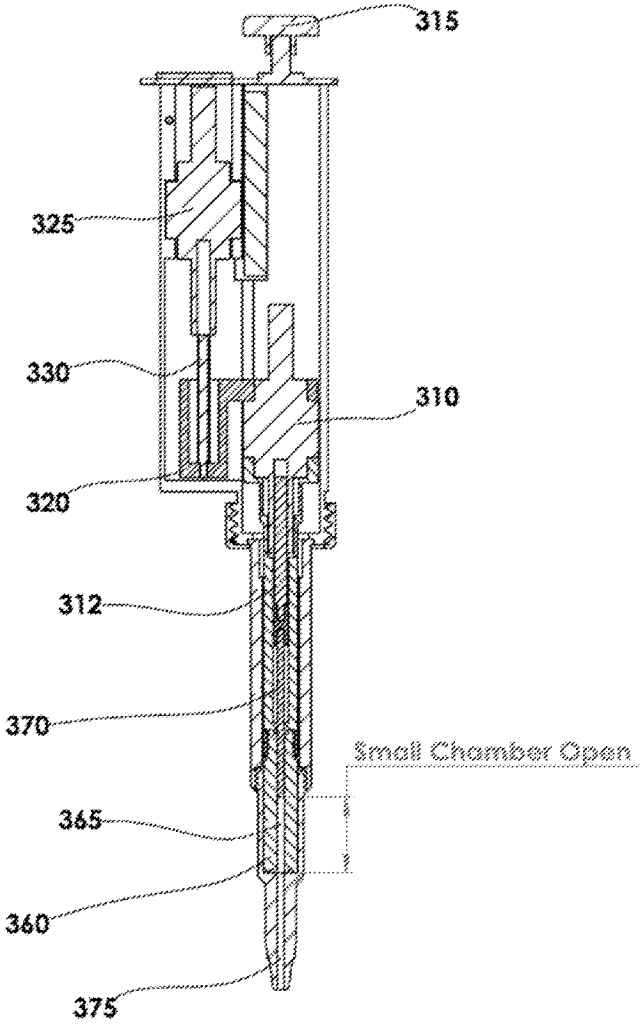
Figure 8C:
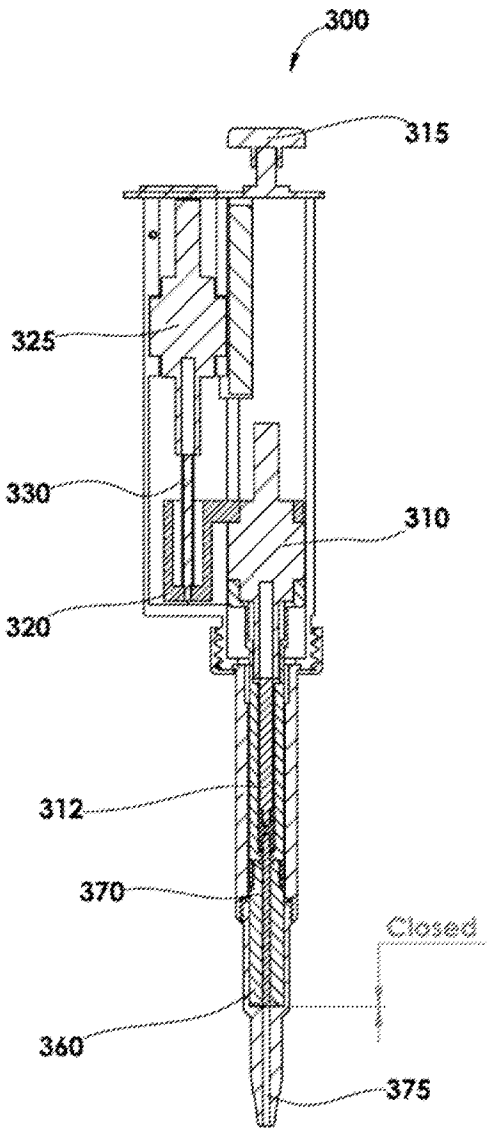

FIGS. 7-8D describe an alternative embodiment of a pipetting device 300 of the present disclosure that includes a cantilever motor connection element 320. The cantilever motor connection element 320 allows for a more ergonomic and space-saving design. Rather than the inline motor driven piston design described above, the cantilever motor connection element 320 is connected to the large volume piston 330 ("first piston") of the large piston motor 325 ("first motor") and the small piston motor 310 ("second motor") in an offset configuration within the pipette housing 305 (see FIG. 7). The user inputs the desired volume by turning the actuating element % volume control 315 as described above, which value is then displayed on the LCD screen 395. As in other embodiments, the LCD screen 395 includes a user interface for selecting the desired volume. When the user inputs larger volumes (e.g., about 50 μl to about 1,000 μl or more), the volume input is communicated to an instrument control PCB 385, which signals the large piston motor 325 to move the small piston motor 310 and large plunger element 360 to the closed position. When the user presses the actuating element/volume control 315, the instrument control PCB 385 signals the large piston motor 325 to move the large volume piston 330, cantilever motor connection element 320, small piston motor 310, and large plunger element 360 upwards. As the large plunger element 360 moves from the closed position upward to the open position within the large vacuum chamber 355 (also referred to herein as the "first vacuum chamber"; see FIGS. 8A and 8D), the vacuum created causes air to be drawn into the fluid inlet 375 and a corresponding amount of liquid to be drawn into a pipette tip affixed to the tip holder 345 as described in detail above. The user then presses the actuating element/volume control 315 a second time to move the large plunger element 360 downwards to the closed position thereby dispelling the liquid from the pipette tip.

When the user inputs smaller volumes (e.g., about 1 μl to about 100 μl), the volume input is communicated to an instrument control PCB 385, which signals the large piston motor 325 to move the small piston motor 310 and large plunger element 360 to the closed position. When the user presses the actuating element/volume control 315, the instrument control PCB 385 signals the small piston motor 310 to move the small volume piston and small plunger element 370 ("second plunger element") from the closed position upwards to the open position within the small vacuum chamber 365 (also referred to herein as the "second vacuum chamber"; see FIGS. 8A and 8D). As the small plunger element 370 moves from the closed position upward to the open position within the small vacuum chamber 365, liquid is drawn into a pipette tip affixed to the tip holder 345 as described in detail above. The user then presses the actuating element/volume control 315 a second time to move the small plunger element 370 downwards to the closed position thereby dispelling the liquid from the pipette tip.

The pipetting device 300 also includes a rechargeable battery 380 and a set of O-rings 372, 363, and 362 to prevent leakage of air between the vacuum chambers and plunger elements.

REFERENCE NUMBERS

10—pipette
12—drive section
14—dispensing section
15—pipette housing
16—motor and piston assembly (electronic drive unit)
18—large plunger assembly
20—actuating element
25—top surface of actuating element
30—ejector element
35—biasing spring (first biasing element, for large tip ejector)
40—ejection sleeve
41—upper ejection sleeve (upper ejection portion)
42—tapered portion of ejection sleeve
43—middle ejection sleeve
44—lower ejection sleeve (lower ejection portion)
45—large tip ejection edge
46—mechanical catch element
47—small tip ejection edge
48—large tip holder (first attachment surface)
49—small tip holder (second attachment surface)
50—fluid inlet/outlet (air)
51—biasing spring (second biasing element, for small tip ejector)
52—dispenser housing
53—nut
54—O-ring (for ejector)
55—large vacuum chamber (first vacuum chamber)
56—O-ring (large plunger)
60—large plunger element
65—small vacuum chamber (second vacuum chamber)
70—small plunger element (second plunger element)
75—seat (large plunger element)
80—seat (small plunger element)
85—fluid passage (dispenser housing)
86—fluid inlet (first fluid inlet, for large vacuum chamber)
88—fluid inlet (second fluid inlet, for large plunger)
90—biasing spring (for small plunger element)
92—upper spring seat
95—small volume piston (second piston)
100—connecting element (threaded)
105—piston receiver
110—small piston motor (second motor)
115—attachment element
120—motor connector element
125—large piston motor (first motor)
130—large volume piston (first piston)
135—small plunger end
140—O-ring (small plunger)
145—large plunger end
155—interior space or bore (small plunger receptacle)
160—motor assembly anchors
162—screw holes
200—pipette
205—pipette housing
208—housing nut
210—small piston motor (second motor)
212—small volume piston (second piston)
215—actuating element/volume control
220—motor connection element
225—large piston motor (first motor)
230—large volume piston (first piston)
235—ejector element
237—biasing spring (first biasing element, for large tip ejector)
240—large tip ejector sleeve
245—small tip holder (second attachment surface)
248—large tip holder/small tip ejector (first attachment surface)
250—O-ring (small tip)
252—dispenser housing
255—large vacuum chamber (first vacuum chamber)
260—large plunger element (first plunger element)
262—O-ring (large plunger)
263—O-ring (large vacuum chamber)
264—large plunger connector
265—small vacuum chamber (second vacuum chamber)
270—small plunger element (second plunger element)
271—(small plunger) connector
272—O-ring (small vacuum chamber)
275—fluid inlet
280—rechargeable battery
285—instrument control PCB
290—biasing spring (second biasing element, for small tip ejector)
295—LCD screen
300—pipette
305—pipette housing
310—small piston motor (second motor)
312—small volume piston (second piston)
315—actuating element/volume control
320—cantilever motor connection element
325—large piston motor (first motor)
330—large volume piston (first piston)
345—tip holder
355—large vacuum chamber (first vacuum chamber)
360—large plunger element (first plunger element)
362—O-ring (large plunger element)
363—O-ring (large vacuum chamber)
365—small vacuum chamber (second vacuum chamber)
370—small plunger element (second plunger element)
372—O-ring (small vacuum chamber)
375—fluid inlet

380—rechargeable battery
385—instrument control PCB
395—LCD screen

We claim:

1. A pipette with a multi-tiered spring-loaded ejector mechanism comprising:

an ejection assembly disposed on a pipette body, the pipette body having an open end to allow a fluid to be introduced into and discharged therefrom, wherein the ejection assembly comprises an ejector element, an upper ejection portion comprising a large tip ejection edge and biased towards an upward position in relation to the open end of the pipette body, a lower ejection portion biased towards an upward position in relation to the open end of the pipette body, a large tip holder portion comprising a small tip ejection edge, and a small tip holder portion, wherein the large tip holder portion comprises a cross section diameter that is greater than a cross section diameter of the small tip holder portion, and wherein the upper ejection portion is configured to be moved downward:

to a first position, wherein the large tip ejection edge contacts and ejects a tip from the large tip holder portion when a first force is applied to the ejector element; or to contact the lower ejection portion and move the lower ejection portion and large tip holder portion to a second position, wherein the small tip ejection edge of the large tip holder portion contacts and ejects a tip from the small tip holder portion when a second force is applied to the ejector element.

2. The pipette of claim 1, further comprising a spring for biasing the upper ejection portion towards the upward position, the lower ejection portion towards the upward position, or both the upper ejection portion and the lower ejection portion towards the upward position.

3. The pipette of claim 1, wherein the first force, the second force, or both the first force and the second force is provided manually by an end user.

4. The pipette of claim 1, further comprising a fluid displacement assembly comprising a first vacuum chamber, a first plunger element, a second vacuum chamber, and a second plunger element, wherein:

the first vacuum chamber comprises a first bore having a first fluid inlet, wherein the first plunger element is slideably positionable within the first bore between a closed position at the first fluid inlet and an open position, and wherein the first fluid inlet is in fluid communication with the open end when the first plunger element is in the open position; and the second vacuum chamber comprises a second bore within the first plunger element and having a second fluid inlet, wherein the second plunger element is slideably positionable within the second bore between a closed position at the second fluid inlet and an open position, and wherein the second fluid inlet is in fluid communication with the open end when the second plunger element is in the open position; and an electronic drive unit for actuating the first plunger element and the second plunger element, the electronic drive unit comprising:

a first motor operably connected to the first plunger element and configured to actuate the first plunger element between the closed position and the open position within the first bore; and a second motor operably connected to the second plunger element and configured to actuate the second plunger element between the closed position and the open position within the second bore;

which first motor and second motor are controlled with a control system, which control system is controlled through a user interface for operating the pipette;

wherein the second plunger element is in the closed position when the first motor causes the first plunger element to move towards the open position by a distance so as to define a first liquid volume to be aspirated by the pipette device in an amount approximately equivalent to a fluid volume displaced by the movement of the first plunger element; and wherein the first plunger element is in the closed position when the second motor causes the second plunger element to move towards the open position by a distance so as to define a second liquid volume to be aspirated by the pipette device in an amount approximately equivalent to a fluid volume displaced by the movement of the second plunger element.

5. The pipette of claim 4, wherein:

(a) the first liquid volume range and the second liquid volume range overlap one another; or (b) the first liquid volume is in a range from between about 10 μl and about 1,500 μl; or (c) the second liquid volume is in a range from about 0.1 μl to about 200 μl; or (d) both (b) and (c).

6. The pipette of claim 4, wherein the first motor is operably connected to the first plunger element by a first piston and the second motor is operably connected to the second plunger element by a second piston.

7. The pipette of claim 4, wherein the first plunger element is cylindrical and has a first cross-section diameter and the second plunger element is cylindrical and has a second cross-section diameter, and wherein the first cross-section diameter is greater than the second cross-section diameter.

8. The pipette of claim 4, wherein:

(a) the first cross-section diameter is between about 3 mm and about 20 mm, and wherein the second cross-section diameter is between about 0.5 mm and about 5 mm;

(b) the ratio of the second cross-section diameter to the first cross-section diameter is 1:1.1 to 1:40; or (c) both (a) and (b).

9. The pipette of claim 1, wherein the fluid is air.

10. The pipette of claim 1, wherein the small tip holder portion is configured for interference fit with a pipette tip capable of aspirating liquid of a volume in the range from about 0.1 μl to about 200 μl.

11. The pipette of claim 10, wherein the small tip holder portion is configured for interference fit with a pipette tip capable of aspirating liquid of a volume in the range from about 0.5 μl to about 200 μl.

12. The pipette of claim 1, wherein the large tip holder portion is configured for interference fit with a pipette tip capable of aspirating liquid of a volume in the range from about 10 μl to about 1,500 μl.

13. The pipette of claim 12, wherein the large tip holder portion is configured for interference fit with a pipette tip capable of aspirating liquid of a volume in the range from about 50 μl to about 1,000 μl.

14. The pipette of claim 1, wherein the small tip holder portion is configured for interference lit with a pipette tip capable of aspirating liquid of a volume in the range from about 0.5 μl to about 200 μl and wherein the large tip holder portion is configured for interference fit with a pipette tip capable of aspirating liquid of a volume in the range from about 50 μl to about 1,000 μl.

* * * * *